US008882234B2

(12) United States Patent
Shinkawa et al.

(10) Patent No.: US 8,882,234 B2
(45) Date of Patent: Nov. 11, 2014

(54) LIQUID EMISSION APPARATUS AND METHOD FOR LIQUID EMISSION

(71) Applicant: Seiko Epson Corporation, Tokyo (JP)

(72) Inventors: Osamu Shinkawa, Chino (JP); Masahiko Yoshida, Shiojiri (JP); Toshiyuki Suzuki, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/852,325

(22) Filed: Mar. 28, 2013

(65) Prior Publication Data

US 2013/0307896 A1 Nov. 21, 2013

(30) Foreign Application Priority Data

May 16, 2012 (JP) ..... 2012-112217

(51) Int. Cl.
*B41J 29/393* (2006.01)
*B41J 2/165* (2006.01)

(52) U.S. Cl.
CPC ..... *B41J 29/393* (2013.01); *B41J 2/16579* (2013.01)
USPC ..... 347/19

(58) Field of Classification Search
USPC ..... 347/9–12, 19
See application file for complete search history.

(56) References Cited

U.S. PATENT DOCUMENTS 7,621,616 B2 * 11/2009 Mitani et al. ..... 347/19
2005/0212845 A1 9/2005 Shinkawa

FOREIGN PATENT DOCUMENTS

JP 2005305992 A 11/2005

* cited by examiner

*Primary Examiner* — Lamson Nguyen
(74) *Attorney, Agent, or Firm* — Harness, Dickey & Pierce, P.L.C.

(57) ABSTRACT

A liquid emission apparatus having a head provided with a plurality of nozzles which each emits liquid, the liquid emission apparatus being configured to emit liquid from the nozzles by applying a driving signal to the driver elements, the liquid emission apparatus being configured to apply the driving signal to the driver elements so as to obtain a plurality of detected signals, to decide whether one of the nozzles corresponding to one of the driver elements is causing a malfunction in liquid emission on the basis of one of detected signals, to drive the driver element corresponding to the nozzle again upon the nozzle having caused a malfunction in liquid emission, and to omit to drive the driver element corresponding to the nozzle upon the nozzle having caused no malfunction in liquid emission.

5 Claims, 9 Drawing Sheets

LIQUID EMISSION APPARATUS AND METHOD FOR LIQUID EMISSION

BACKGROUND

1. Technical Field

The present invention relates to a liquid emission apparatus, a method for liquid emission and a program.

2. Related Art

An ink jet printer (called printer, hereafter) which emits an ink drop from a nozzle provided to a head so as to print an image on a sheet of paper can be enumerated as an exemplary liquid emission apparatus. Specifically, the printer makes ink in a pressure chamber change in pressure by driving a driver element, so that an ink drop is emitted from a nozzle linked to the pressure chamber. In such a printer, an ink solvent may sometimes evaporate from the nozzle causing the ink in the nozzle grow more viscous or a bubble may get into the ink chamber, resulting in malfunctioning ink emission from the nozzle. Thus, a method for testing a malfunctioning nozzle which causes malfunctioning emission on the basis of a residual vibration remaining after the ink in the ink chamber is made change in pressure by means of the fact that the driver element is driven is disclosed, e.g., in JP-A-2005-305992.

A malfunctioning nozzle may be either in a no emission state where no ink is emitted at all from the nozzle, or in a failed emission state where ink is, although irregularly, emitted from the nozzle. The failed emission is, e.g., such that a specified amount of ink is not emitted from the nozzle, or that an ink drop emitted from the nozzle spatters in the wrong direction. However, the malfunctioning nozzle cannot be tested into its detailed conditions according to the ordinary test methods, resulting in a problem that a process according to an extent to which the malfunctioning nozzle malfunctions cannot be run, etc.

SUMMARY

An advantage of some aspects of the invention is to test a state of a nozzle causing malfunctioning liquid emission in detail.

The invention to solve the above problem is primarily of a liquid emission apparatus having a head and a controller. The head has a plurality of nozzles which each emits liquid, pressure chambers provided correspondingly to each of the nozzles each liked to corresponding one of the nozzles, and driver elements each provided correspondingly to each of the pressure chambers. The controller applies a driving signal to and drives one of the driver elements so as to cause liquid in one of the pressure chambers corresponding to the driver element to change in pressure. The controller drives the same driver element more than once so as to obtain a plurality of detected signals, and decides whether one of the nozzles corresponding to the driver element in a state of malfunctioning liquid emission is either in a state in which no ink is emitted or in a state in which liquid is emitted although irregularly.

Other characteristics of the invention will be disclosed by descriptions in the specification and the drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of Disclosure

Figure 1A:
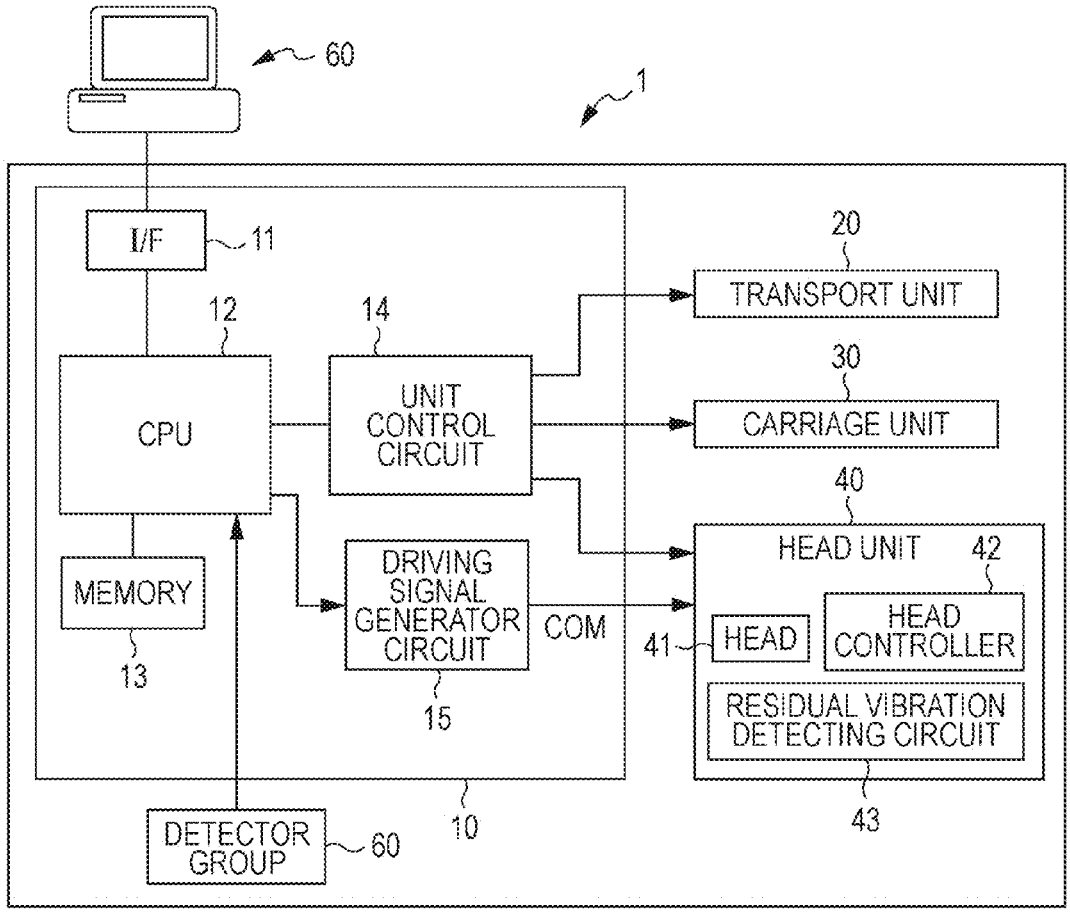
FIG. 1A is a block diagram which shows an entire setup of a printing system.

The followings are disclosed in the least by descriptions in the specification and the drawings.

What is disclosed is a liquid emission apparatus having a head and a controller. The head has a plurality of nozzles which each emits liquid, pressure chambers provided correspondingly to each of the nozzles each liked to corresponding one of the nozzles, and driver elements each provided correspondingly to each of the pressure chambers. The controller applies a driving signal to and drives one of the driver elements so as to cause liquid in one of the pressure chambers corresponding to the driver element to change in pressure. The controller drives the same driver element more than once so as to obtain a plurality of detected signals, and decides whether one of the nozzles corresponding to the driver element in a state of malfunctioning liquid emission is either in a state in which no ink is emitted or in a state in which liquid is emitted although irregularly.

According to such a liquid emission apparatus, a process according to an extent to which the liquid emission malfunctions can be run.

The controller of the liquid emission apparatus decides whether one of the nozzles corresponding to one of the driver elements is causing a malfunction in liquid emission on the basis of one of detected signals obtained by means of the fact that the driver elements are driven. The controller drives the driver element corresponding to the nozzle again upon the nozzle having caused a malfunction in liquid emission, and omits to drive the driver element corresponding to the nozzle upon the nozzle having caused no malfunction in liquid emission.

According to such a liquid emission apparatus, time for test can be shortened.

The controller of the liquid emission apparatus drives the same driver element more than once so as to obtain the detected signals. The controller decides a state of the nozzle corresponding to the driver element on the basis of a variation in the respective detected signals.

According to such a liquid emission apparatus, to what extent a nozzle causing malfunctioning liquid emission malfunctions can be decided.

The controller of the liquid emission apparatus compares a variation in cycles of the respective detected signals obtained by means of the fact that the same driver element is driven more than once with a first threshold, and decides whether the state of the nozzle is either a state in which no liquid is emitted or a state in which liquid is emitted although irregularly.

According to such a liquid emission apparatus, to what extent a nozzle causing malfunctioning liquid emission malfunctions can be decided.

The controller of the liquid emission apparatus drives the driver element in such a way that first vibrating force is provided so as to obtain a first detected signal, drive the driver element in such a way that second vibrating force being stronger than the first vibrating force is provided so as to obtain a second detected signal, and decides a state of the nozzle corresponding to the driver element on the basis of first detected signal and the second detected signal.

According to such a liquid emission apparatus, to what extent a nozzle causing malfunctioning liquid emission malfunctions can be decided. Further, a nozzle causing malfunctioning liquid emission can be more precisely detected.

The controller of the liquid emission apparatus compares a difference between an amplitude of the first detected signal and an amplitude of the second detected signal with a second threshold, and decides whether the state of the nozzle is either a state in which no liquid is emitted or a state in which liquid is emitted although irregularly.

According to such a liquid emission apparatus, to what extent a nozzle causing malfunctioning liquid emission malfunctions can be decided.

Further, a test method for testing a head having a plurality of nozzles which each emits liquid, pressure chambers provided correspondingly to each of the nozzles each liked to corresponding one of the nozzles, and driver elements each provided correspondingly to each of the pressure chambers is provided. The test method includes obtaining a plurality of detected signals by driving the same driver element more than once and deciding, if the nozzle corresponding to the driver element causes malfunctioning liquid emission, whether a state of the nozzle is a state in which no liquid is emitted or a state in which liquid is emitted although irregularly on the basis of the plural detected signals.

According to such a test method, a process according to an extent to which the liquid emission malfunctions can be run.

Further, a program to make a computer test a head having a plurality of nozzles which each emits liquid, pressure chambers provided correspondingly to each of the nozzles each liked to corresponding one of the nozzles, and driver elements each provided correspondingly to each of the pressure chambers is provided. The program makes a computer achieve functions to obtain a plurality of detected signals by driving the same driver element more than once, and to decide, if the nozzle corresponding to the driver element causes malfunctioning liquid emission, whether a state of the nozzle is a state in which no liquid is emitted or a state in which liquid is emitted although irregularly on the basis of the plural detected signals.

According to such a program, a process according to an extent to which the liquid emission malfunctions can be run.

Printing System

Suppose that a "liquid emission apparatus" is an ink jet printer (called printer, hereafter). An embodiment exemplified by a printing system in which the printer is coupled with a computer will be explained.

Figure 1B:
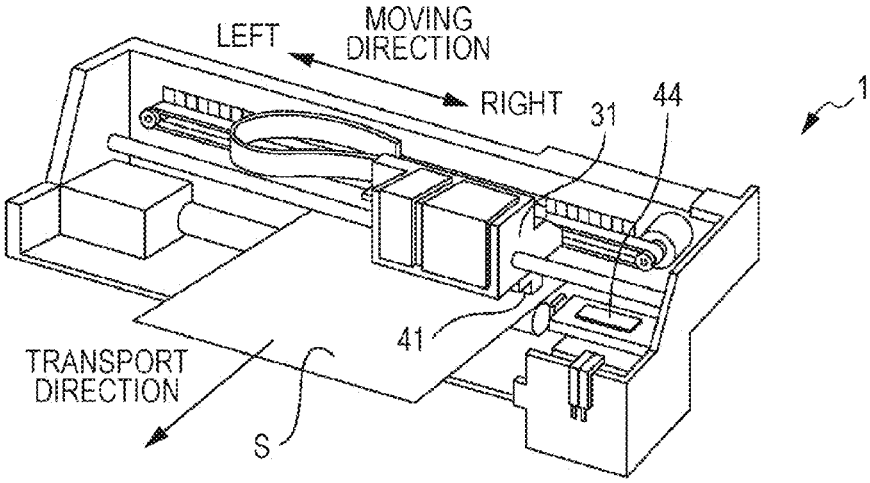
FIG. 1B shows a schematic perspective view of the printer.
Figure 2A:
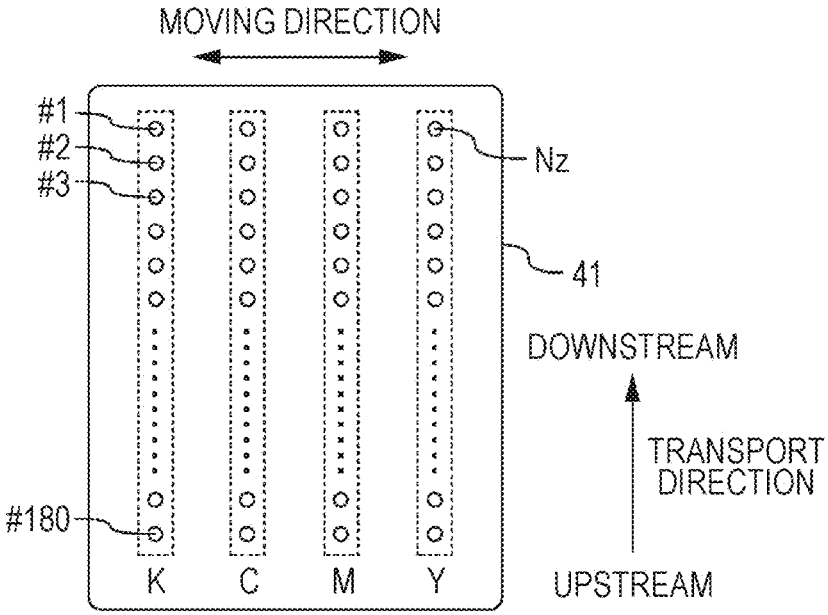
FIG. 2A shows a nozzle aperture face of a head.
Figure 2B:
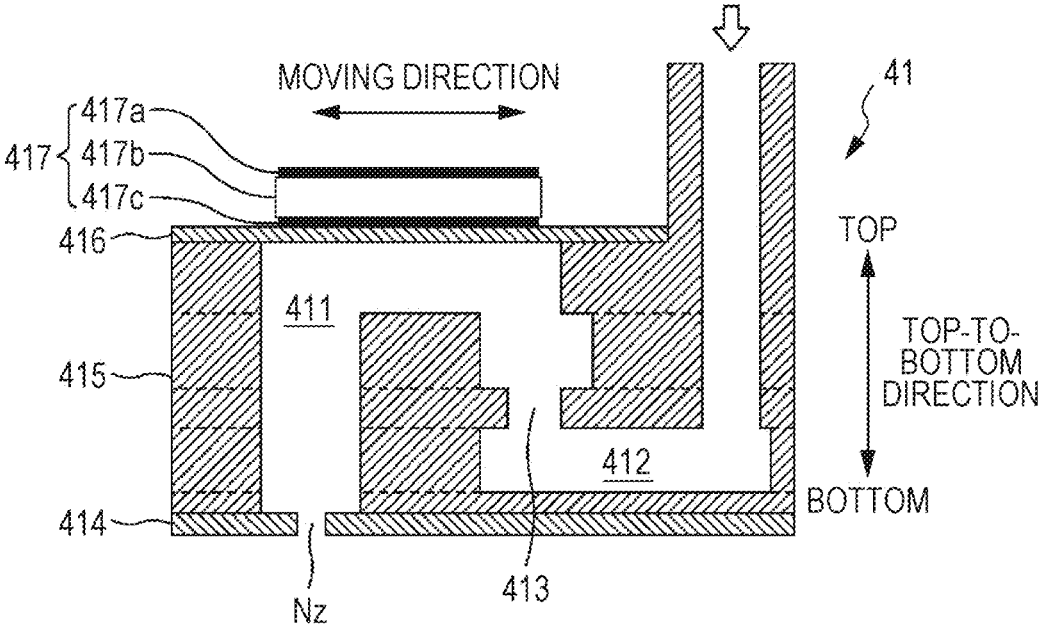
FIG. 2B is a cross section of the head as viewed from a direction in which a medium is transported.

FIG. 1A is a block diagram which shows an entire setup of a printing system. FIG. 1B gives a schematic perspective view of a printer 1. FIG. 2A shows a nozzle aperture face of a head 41. FIG. 2B is a cross section of (a portion of) the head 41 as viewed from a direction in which a medium S is transported.

The printer 1 has a controller 10, a transport unit 20, a carriage unit 30, a head unit 40 and a detector group 50. The printer 1 is communicably coupled with a computer 60. A printer driver installed in the computer 60 makes printing data to make the printer 1 print an image or provides the printer 1 with the printing data by using hardware resources in the computer 60.

The controller 10 in the printer 1 is to entirely control the printer 1. An interface section 11 transmits and receives data to and from the computer 60 being an external apparatus. A CPU 12 is an arithmetic processing device to entirely control the printer 1, and controls respective units via a unit control circuit 14. A memory 13 is to secure an area in which a program to be run by the CPU 12 is filed, a working area, etc. The detector group 50 is to watch conditions in the printer 1 and to provide a controller 10 with a detected result of it.

The transport unit 20 is to feed a medium S made of paper, cloth, film sheet, etc., into a position where printing is available, and to transport the medium S in the transport direction.

The carriage unit 30 is to move the head 41 mounted on a carriage 31 in a direction crossing (perpendicular to, in general) the transport direction of the medium S.

The head unit 40 has the head 41 which emits ink (liquid) onto the medium S, a head controller 42, a residual vibration detecting circuit 43 and a cap 44. In the head 41, as shown in FIG. 2B, lots of nozzles Nz which each emit an ink drop are formed, and so are a pressure chamber 411 provided for every one of the nozzles Nz and linked to a corresponding one of the nozzles Nz, a common ink chamber 412 provided for every ink color to be provided with ink from an ink cartridge, and an ink supply outlet 413 which links the plural pressure chambers 411 to be loaded with ink of a same color and the common ink chamber 412, as paths of ink flows.

Further, on the nozzle aperture face (lower face at present) of the head 41, a black nozzle line K which emits black ink is formed as shown in FIG. 2A, and so are a cyan nozzle line C, a magenta nozzle line M and a yellow nozzle line Y which emit cyan, magenta and yellow ink, respectively. The nozzle lines each include 180 nozzles Nz forming a line along the transport direction at regular intervals. The nozzles in each of the nozzle lines are given numerals in ascending order (#1-#180) for explanation starting from the one located on the most downstream side in the transport direction.

Further, in the head 41, a nozzle plate 414 in which the nozzle Nz is formed is fastened to a lower face of a flow path forming board 415 in which the pressure chamber 411 and the common ink chamber 412 are formed. A vibration board 416 is fastened onto a top of the flow path forming board 415 and forms a ceiling portion of the pressure chamber 411. Further, a driver element 417 is mounted on a top of the vibration board 416 for every pressure chamber 411. The driver element 417 shown in FIG. 2B is formed by a piezoelectric element 417*b* arranged between two electrodes 417*a* and 417*c*. The arrangement of the driver element 417 is not limited to the above, and a laminated piezoelectric actuator may be applied to the driver element.

Then, if the controller 10 (controller) applies a driving signal COM generated by a driving signal generator circuit 15 to the driver element 417, a degree of how much the driver element 417 warps changes in a top-to-bottom direction, and the vibration board 416 changes its position in the top-to-bottom direction. The pressure chamber 411 resultantly changes in volume (expands or contracts), the ink in the pressure chamber 411 changes in pressure and an ink drop is emitted from the nozzle Nz linked to the pressure chamber 411.

The head controller 42 is to control driving of the head 41, and selectively applies the driving signal COM to the driver element 417 according to printing data. The residual vibration detecting circuit 43 is to detect a residual vibration remaining after the ink in the pressure chamber 411 is made change in pressure (which will be described later in detail) by driving of the driver element 417.

The cap 44 is arranged at a home position (in an area on a right end portion in a moving direction in which no printing is done) in such a way that the cap 44 can face the nozzle aperture face of the head 41 which moves in the moving direction. The cap 44 receives an ink drop emitted from the nozzle Nz in time of cleaning of the head 41. The cap 44 is fit close to the nozzle aperture face of the head 41 and seals the nozzle Nz so as to control evaporation of ink solvent from the nozzle Nz.

The controller 10 repeats an emission operation to emit ink drops from the nozzles as moving the head 41 in the moving direction by means of the carriage 31 and a transport operation to transport the medium S in the transport direction by means of the transport unit 20 alternately in the above setup of the printer 1. As a result, after a first dot is formed on a first position by a first emission operation, a second dot is formed on a second position which is different from the first position by a later second emission operation, so that a 2D image is printed on the medium S.

To Drive Head 41

Figure 3A:
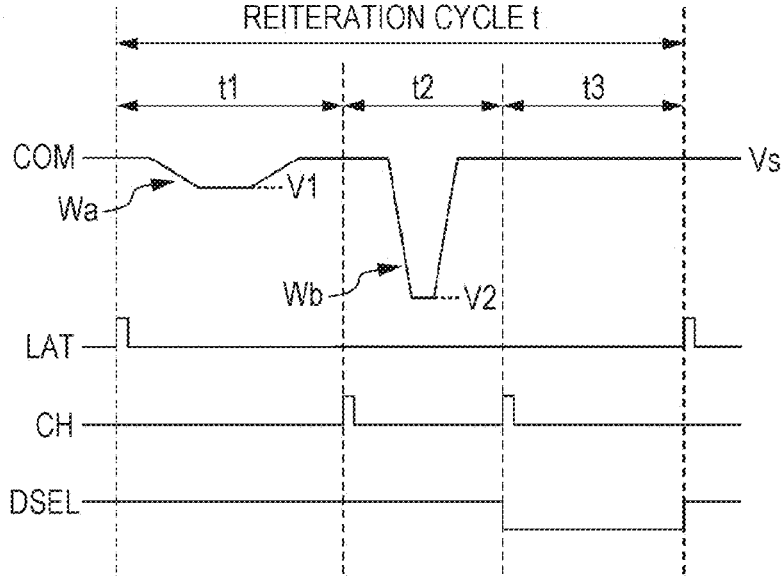
FIG. 3A illustrates a driving signal to drive a driver element.
Figure 3B:
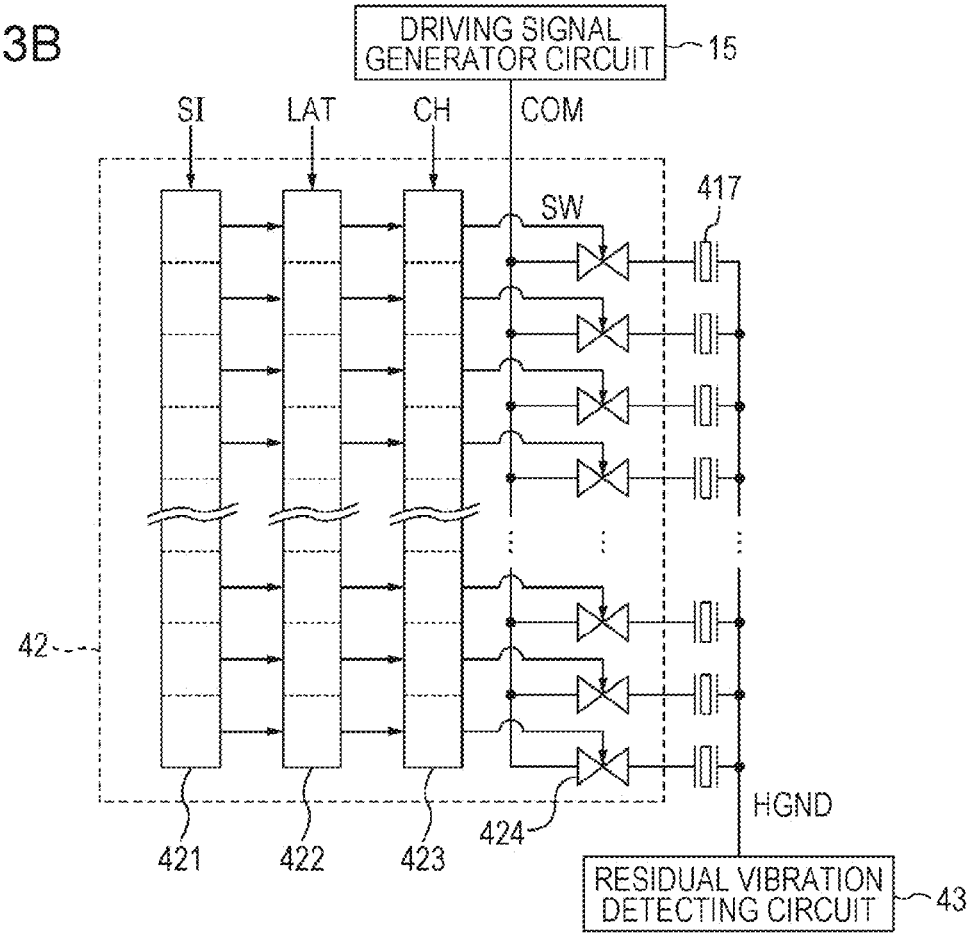
FIG. 3B illustrates a head controller.

FIG. 3A illustrates the driving signal COM to drive the driver element 417. FIG. 3B illustrates the head controller 42. Suppose, for the embodiment, that the nozzles Nz each form a single-sized dot and one pixel (unit area in which one dot is formed) on the medium S is expressed by two levels of gradation. A period of time for which the nozzle Nz faces one pixel on the medium S is called a "reiteration cycle t", and a rising pulse of a latch signal LAT specifies the reiteration cycle t. Further, the reiteration cycle t can be divided into a first period t1, a second period t2 and a third period t3. The respective periods t1, t2 and t3 alternate with one another at timing when a rising pulse appears on a changeover signal CH. On the driving signal COM, a minute vibration waveform Wa and an emission waveform Wb appear in the first period t1 and the second period t2, respectively, and a waiting voltage Vs is held in the third period t3.

The minute vibration waveform Wa is a waveform for minutely vibrate the ink in the nozzle Nz and the pressure chamber 411 without emitting an ink drop from the nozzle Nz. Specifically, a waveform portion dropping from the waiting voltage Vs to the first voltage V1 causes the pressure chamber 411 expand and a meniscus (free surface of the ink exposed from the nozzle aperture) in the nozzle is pulled into the pressure chamber 411. Then, for a period of time that a waveform portion holding the first voltage V1 is being applied to the driver element 417 for, the meniscus freely vibrates and the ink in the nozzle Nz, etc., vibrates so minutely that no ink drop is emitted from the nozzle Nz. Thus, the ink in the nozzle is stirred and prevented from growing more viscous and clogging the nozzle Nz up. Finally, a waveform portion rising from the first voltage V1 to the waiting voltage Vs causes the pressure chamber 411 returning to the initial condition.

The emission waveform Wb is a waveform for emitting an ink drop from the nozzle Nz to print, which is specifically explained as follows. A waveform portion dropping from the waiting voltage Vs to the second voltage V2 causes the pressure chamber 411 expand and the pressure of the ink in the ink chamber 411 falls. Then, a waveform portion rising from the second voltage V2 to the waiting voltage Vs causes the ink chamber 411 contract and the pressure of the ink in the ink chamber 411 increase, so that an ink drop is emitted from the nozzle Nz.

The head controller 42 has a shift register 421, a latch circuit 422, a level shifter 423 and a switch 424 for each of the driver elements 417 (for each of the nozzles Nz) as shown in FIG. 3B. An operation flow until the head controller 42 applies the driving signal COM to the driver element 417 will be explained below.

To begin with, the controller 10 serially transmits pixel data SI (printing data) in a certain reiteration cycle t to the head controller 42. Incidentally, the pixel data SI is, e.g., data [1] indicating that a dot is formed on a pixel, or data [0] indicating that no dot is formed on the pixel. Then, the pixel data SI allotted to each of the driver elements 417 is held by the shift register 421 corresponding to the relevant driver element 417.

Then, the latch circuit 422 holds the pixel data SI filed in the shift register 421 on the basis of the latch signal LAT, and provides the level shifter 423 with a logical signal according to the pixel data SI. The level shifter 423 outputs a switch control signal SW to control turn-on and turn-off operations of the switch 424 on the basis of the logical signal provided by the latch circuit 422 and the changeover signal CH. The level shifter 423 changes a value of the switch control signal SW at the timing when a rising pulse appears on the changeover signal CH. Further, the plural switches 424 are coupled with one another on their one ends in common, and the switches 424 are each provided with the common driving signal COM generated by the driving signal generator circuit 15. Further, the driver elements 417 are coupled with one another on their opposite ends in common (grounded end HGND), and with the residual vibration detecting circuit 43. The driving signal COM is applied to the driver element 417 while the switch 424 is being on (closed), and is not applied to the driver element 417 while the switch 424 is being off (open).

If, e.g., the pixel data SI [1] indicating that a dot is formed on a pixel is allotted in time of printing, the switch 424 is turned on and the driving signal COM is applied to the driver element 417 in the second period t2 included in the reiteration cycle t, so that the emission waveform Wb makes an ink drop emitted from the nozzle Nz. If the pixel data SI [0] indicating that no dot is formed on the pixel is allotted in the opposite way, the switch 424 is turned on in the first period t1 included in the reiteration cycle t, and the driving signal COM is applied to the driver element 417 in the first period t1. The minute vibration waveform Wa thereby makes the ink in the nozzle vibrate so minutely that no ink drop is emitted from the nozzle Nz. The emission of an ink drop from each of the nozzles can be controlled according to the pixel data SI in this way. Malfunctioning nozzle and cleaning process Malfunctioning Nozzle As no ink drop is emitted from a nozzle Nz infrequently used during a printing operation for a relatively long period of time, an ink solvent may sometimes evaporate from the nozzle Nz in the meantime, and the ink in the nozzle or the pressure chamber 411 may grow more viscous resulting in that the nozzle Nz is clogged up. Then, malfunctioning ink emission is caused such that no ink drop is emitted at all from the nozzle Nz, that an unspecified and wrong amount of ink is emitted, or that an ink drop emitted from the nozzle spatters in the wrong direction and reaches a wrong position.

Further, a bubble may sometimes get into the pressure chamber 411. Even if the driving signal COM is applied to the driver element 417 and the pressure chamber 411 is made expand and contract in such a case, the ink in the pressure chamber 411 cannot be properly pressurized resulting in malfunctioning ink emission. If an image is printed by the use of a nozzle causing malfunctioning emission because of the ink having grown more viscous or bubble mixing, quality of the printed image is degraded.

Cleaning Process

Thus, if the ink having grown more viscous or bubble mixing causes a malfunctioning nozzle, it is preferable to perform a cleaning process for the head 41 in order that an ink drop is regularly emitted from the malfunctioning nozzle. The printer 1 of the embodiment runs a flashing process and a pump absorption process for the cleaning process for the head 41.

The flashing process is to move the head 41 to the home position and to force the nozzle Nz emit an ink drop to the cap 44. For example, apply the emission waveform Wb shown in FIG. 3 successively to the driver element 417, in order that the ink having grown more viscous is discharged from the nozzle Nz and so is the bubble and that the malfunctioning nozzle can recover to a normally working nozzle.

The pump absorption process is to fit the cap 44 close to the head 41 in such a way as to enclose the nozzle Nz in a depression formed on the top of the cap 44, and then absorbing air in a closed space formed between the depression on the cap 44 and the nozzle face of the head 41 by means of a pump. Such a process renders pressure in the closed space negative, discharges the ink having grown more viscous and the bubble from the nozzle, so that the malfunctioning nozzle can recover to a normally working nozzle.

Residual Vibration Detecting Circuit 43

Figure 4A:
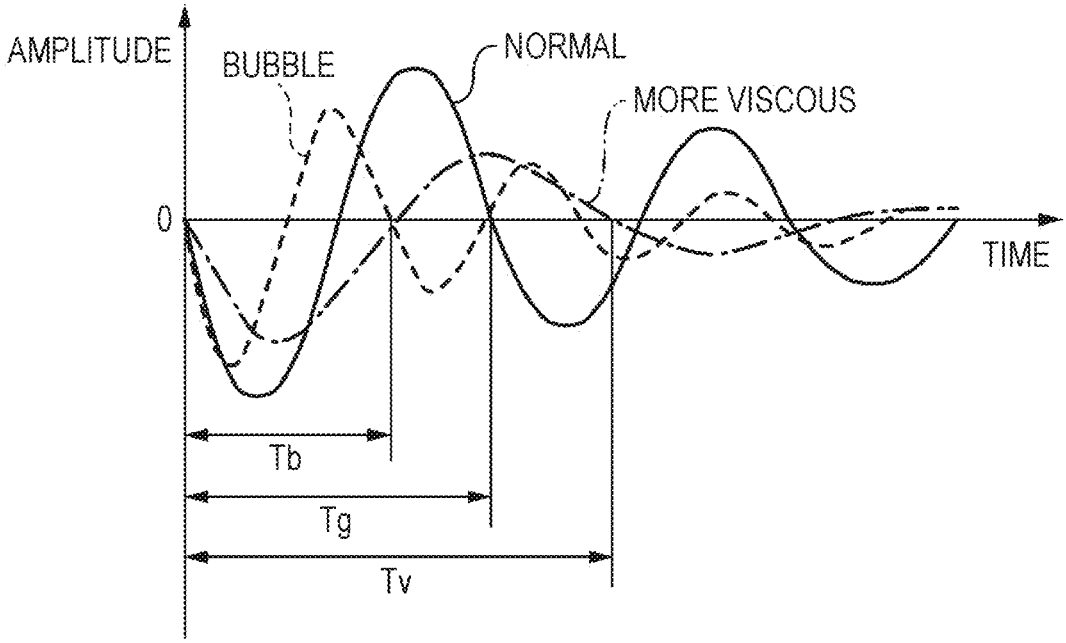
FIG. 4A shows an exemplary waveform of a residual vibration.
Figure 4B:
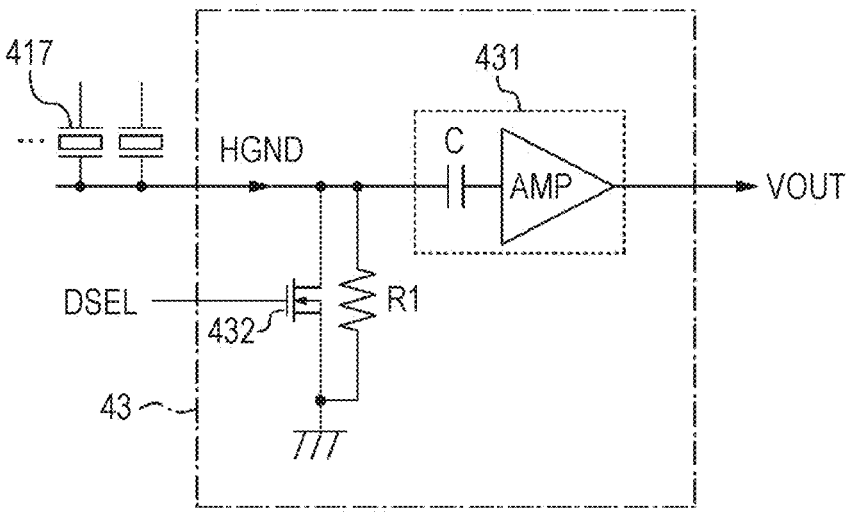
FIG. 4B illustrates a residual vibration detecting circuit.

FIG. 4A shows exemplary waveforms of residual vibrations remaining after the driving element 417 is driven so that the ink in the pressure chamber 411 is thereby made change in pressure. FIG. 4B illustrates the residual vibration detecting circuit 43 which detects a residual vibration. FIG. 4A shows a graph having a vertical axis indicating amplitude of a residual vibration and a horizontal axis indicating time. Further, FIG. 4A shows a waveform of a residual vibration (normal) when an ink drop is normally emitted from the nozzle Nz, a waveform of a residual vibration (bubble) when a bubble has gotten into the nozzle Nz and the pressure chamber 411 and no ink is emitted from the nozzle Nz, and a waveform of a residual vibration (more viscous) when the ink in the nozzle Nz and the pressure chamber 411 has grown more viscous and no ink is emitted from the nozzle Nz. Suppose that the driving signal COM (e.g., emission waveform Wb) is applied to the driver element 417, that the driver element 417 is driven, and that the ink in the pressure chamber 411 corresponding to the relevant driver element 417 is made change in pressure. Then, afterwards, residual vibrations (free vibrations) occur to the ink in the pressure chamber 411 or the vibration board 416. How the residual vibrations occur tells conditions in the nozzle Nz and the pressure chamber 411.

If a step response is calculated for a volume velocity u in a case where a calculation model of a single vibration supposing a residual vibration on the vibration board 416 is given a pressure value P, following equations (1)-(3) are obtained.

$$u = \frac{P}{\omega \cdot m} e^{-\omega t} \cdot \sin \omega t \tag{1}$$

-continued $$\omega = \sqrt{\frac{1}{m \cdot C} - \alpha^2} \tag{2}$$

$$\alpha = \frac{r}{2m} \tag{3}$$

Incidentally, the flow path resistance value r is determined by flow path shapes of the ink supply outlet 413, the pressure chamber 411, the nozzle Nz, etc., and the ink viscosity in the flow path. The inertance m is determined by ink weight in the flow path, i.e., the ink supply outlet 413, the pressure chamber 411, the nozzle Nz, etc. The compliance value C is determined by flexibility of the vibration board 416.

If, e.g., a bubble gets into the pressure chamber 411 and the nozzle Nz resulting in an occurrence of no ink emission, the ink weight (inertance m) decreases as much as the bubble has mixed. Thus, the angular velocity ω grows as shown by the above equation (2) resulting in a shorter vibration cycle (higher vibration frequency). Thus, a cycle Tb of a residual vibration in time of no ink emission caused by bubble mixing turns shorter than a cycle Tg of a residual vibration in time of normal ink emission (Tb<Tg) as shown in FIG. 4A.

Meanwhile, if the ink in the pressure chamber 411 and the nozzle Nz grows dry and more viscous causing no ink emission, the flow path resistance value r increases resulting in that the amplitude decreases (attenuation ratio increases). Further, the angular velocity ω decreases as shown in the equations (2) and (3), resulting in a longer vibration cycle (lower vibration frequency). Thus, a cycle Tv of a residual vibration in time of no ink emission caused by the ink having grown more viscous is shorter than the cycle Tg of the residual vibration in time of normal ink emission (Tv>Tg) as shown in FIG. 4A.

The residual vibrations tell conditions in the nozzle Nz and the pressure chamber 411 as described above. Thus, the residual vibration detecting circuit 43 of the printer 1 of the embodiment detects a residual vibration remaining after the driver element 417 is driven so that the ink in the pressure chamber 411 is made change in pressure, and the controller 10 tests the condition of the nozzle on the basis of the resultant detection. Specifically, the residual vibration detecting circuit 43 detects a mechanical displacement of the piezo-electric element 417*b* (driver element 417) caused by the residual vibration of the vibration board 416 in the form of a change in electromotive voltage of the piezoelectric element 417*b*. Incidentally, the residual vibration detecting circuit 43 is provided for the plural driver elements 417 in common. Electrodes on the ground sides of the respective driver elements 417 are coupled with one another in common (grounded end HGND), and with the residual vibration detecting circuit 43.

Further, the residual vibration detecting circuit 43 has a switch 432 (N-channel MOSFET) which grounds or opens the grounded end HGND of the driver element 417, a resistor R1 electrically coupled parallel to the switch 432, and an ac amplifier 431 which amplifies an ac component of the electromotive voltage of the driver element 417 (piezo-electric element 417*b*). The ac amplifier 431 is formed by a capacitor C which removes a dc component included in the electromotive voltage of the driver element 417 and an amplifier Amp which amplifies the ac component remaining after the dc component is removed.

Suppose, e.g., that a residual vibration of a test nozzle is detected. Transmit a driving signal COM to the head controller 42, and turn on the switch 424 in the head controller 42 (FIG. 3B) corresponding to the test nozzle in the second period t2 in the reiteration cycle t. Further, set a gate signal DSEL to an H level so as to turn on the switch 432 in the residual vibration detecting circuit 43. The grounded end HGND of the driver element 417 is thereby grounded, and the driving signal COM (emission waveform Wb) is applied to the driver element 417 corresponding to the test nozzle and the driver element 417 is driven, so that the ink in the pressure chamber 411 corresponding to the test nozzle changes in pressure.

Then, fix the voltage of the driving signal COM (Vs) and turn on only the switch 424 in the head controller 42 corresponding to the test nozzle in the third period t3 in the reiteration cycle t. Further, set the gate signal DSEL to an L level so as to turn off the switch 432 in the residual vibration detecting circuit 43, so that the grounded end HGND of the driver element 417 is separated from the ground. The electromotive voltage of the driver element 417 corresponding to the test nozzle (i.e., electromotive voltage according to the residual vibration) is obtained by the residual vibration detecting circuit 43. The electromotive voltage of the driver element 417 is amplified by the ac amplifier 431 (VOUT), and then is transmitted to the controller 10. The detected signal VOUT transmitted to the controller 10 is a signal according to the residual vibration remaining after the driver element 417 is driven so that the ink in the pressure chamber 411 corresponding to the driver element 417 is made change in pressure. Thus, the controller 10 tests conditions in the test nozzle and the pressure chamber 411 on the basis of the received detected signal VOUT.

The controller 10 (controller which corresponds to the computer) in the printer 1 of the embodiment shown below tests malfunctioning ink emission from the nozzle on the basis of the detected signal VOUT coming from the residual vibration detecting circuit 43, e.g., according to a program stored in the memory 13. Who runs the test is not limited to the above, though, and the computer 60 coupled with the printer 1 may test the nozzle on the basis of the detected signal VOUT coming from the residual vibration detecting circuit 43. Further, suppose that the nozzle is tested after printing is stopped (e.g., before printing starts) as to the embodiment shown below, and a test of one of the nozzle lines formed on the nozzle aperture face (FIG. 2A) of the head 41 will be explained as an example.

First Embodiment

Test Method

Figure 5A:
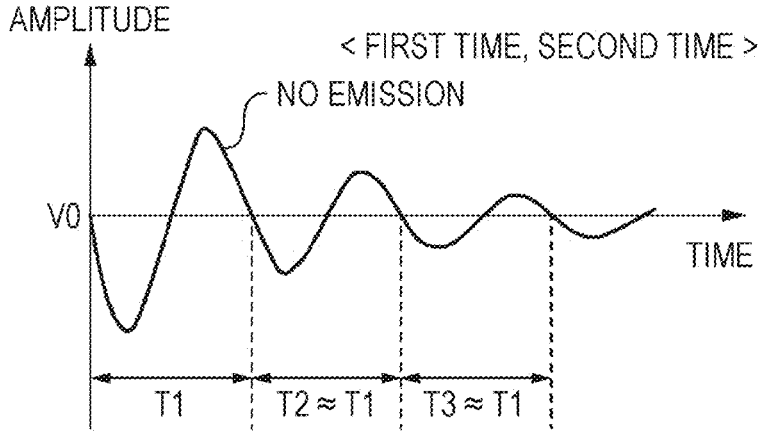
FIG. 5A shows a residual vibration of a malfunctioning nozzle in a no emission state.
Figure 5B:
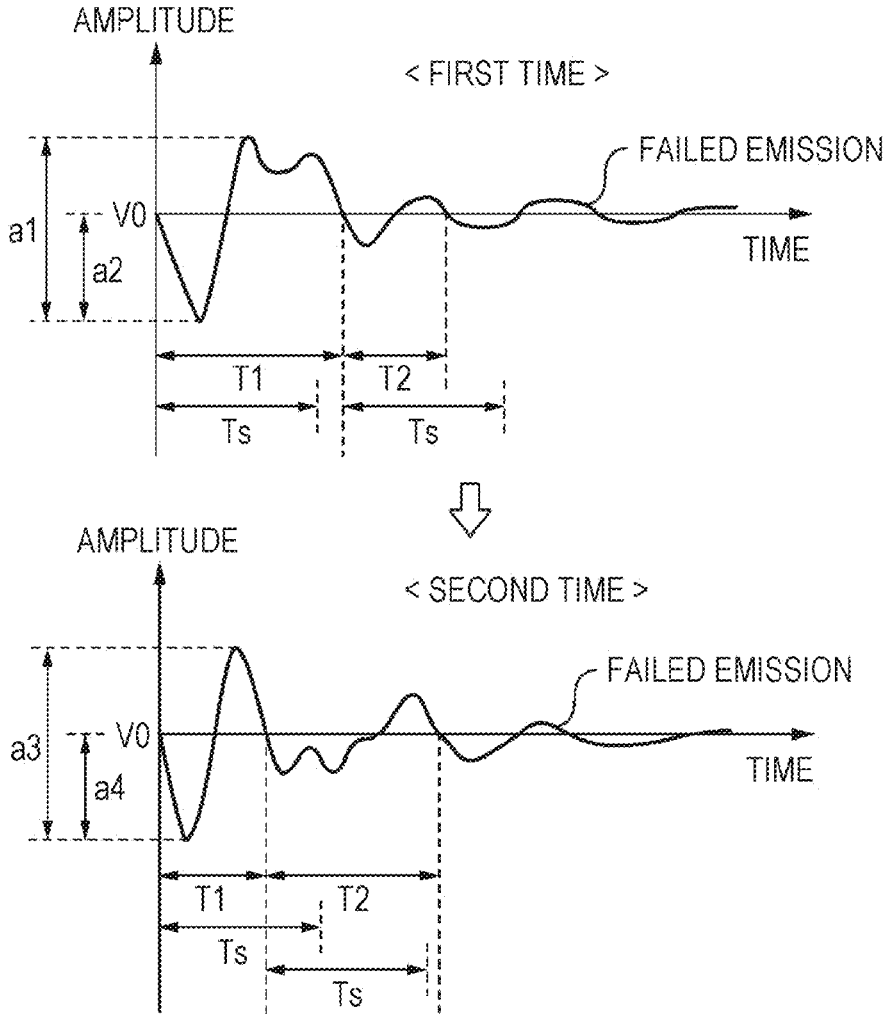
FIG. 5B shows a residual vibration of a malfunctioning nozzle in a failed emission state.
Figure 6:
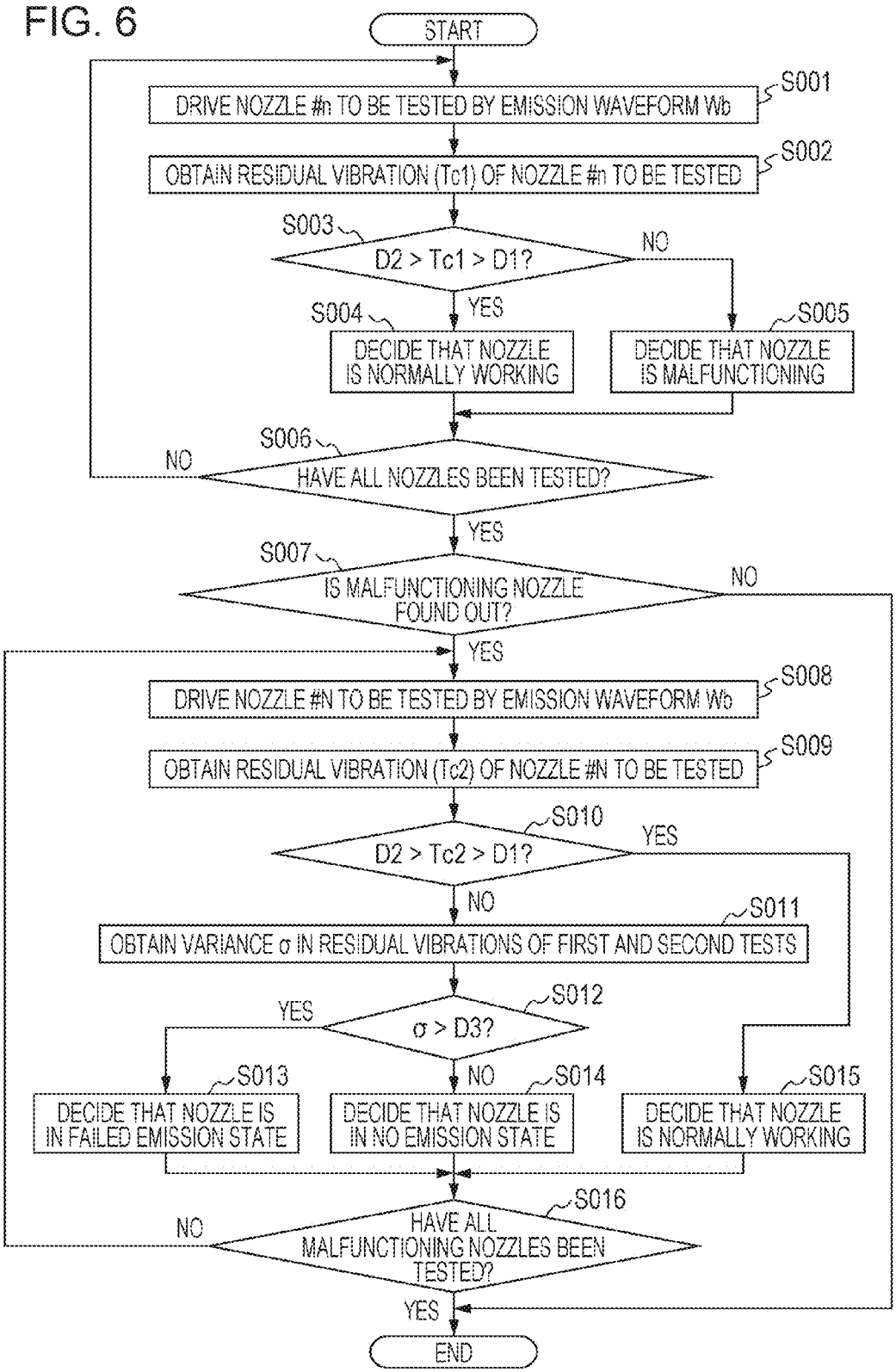
FIG. 6 shows a flow of a test method of a first embodiment.

FIG. 5A illustrates an exemplary waveform of a residual vibration (detected signal VOUT) caused by a malfunctioning nozzle in a no emission state. FIG. 5B illustrates an exemplary waveform of a residual vibration caused by a malfunctioning nozzle in a failed emission state. FIG. 6 shows a flow of a test method of the first embodiment. Incidentally, horizontal and vertical axes in FIG. 5 represent time and amplitude (voltage) of the residual vibration, respectively. Further, in the explanation below, a time length between a point where the amplitude equals a reference voltage V0 and a point where the amplitude returns to the reference voltage V0 next time is called a "cycle", and first and following cycles obtained from the detected signal VOUT are called a first cycle T1, a second cycle T2, a third cycle T3 and so on, respectively.

A "malfunctioning nozzle" causing malfunctioning ink emission is either in the "no emission state" where a degree of the malfunction is serious, i.e., no ink is emitted at all from the nozzle, or in the "failed emission state" where the degree of the malfunction is less serious, i.e., although ink is emitted from the nozzle, a specified amount of ink is not emitted or an ink drop spatters in the wrong direction and reaches a wrong position. FIG. 5A illustrates a detected signal VOUT obtained from the residual vibration detecting circuit 43 by means of the fact that a driver element 417 corresponding to a malfunctioning nozzle in the no emission state (called "no emission nozzle" hereafter) is driven twice. FIG. 5B illustrates a detected signal VOUT obtained from the residual vibration detecting circuit 43 by means of the fact that a driver element 417 corresponding to a malfunctioning nozzle in the failed emission state (called "failed emission nozzle" hereafter) is driven twice.

As shown in FIG. 5A, the detected signals VOUT obtained by means of the fact that the driver element 417 corresponding to a no emission nozzle is driven firstly and secondly are of waveforms substantially the same as each other. Specifically, the first period T1 of the first detected signal VOUT is as long as the first period T1 of the second detected signal VOUT. As shown in FIG. 4A described above, though, a cycle of a residual vibration caused by a no emission nozzle may be sometimes shorter and sometimes longer than that of a residual vibration caused by a normally working nozzle. Further, the first period T1 of each of the detected signals VOUT is as long as the following cycles T2, T3 and so on. Thus, e.g., the second cycle T2 of the first detected signal VOUT is as long as the second cycle T2 of the second detected signal VOUT, and the third cycle T3 of the first detected signal VOUT is as long as the third cycle T3 of the second detected signal VOUT. That is, the cycles in the residual vibration caused by the no emission nozzle are of a certain steady length.

The detected signal VOUT (residual vibration) obtained by means of the fact that the driver element 417 which corresponds to a no emission nozzle is steady, and waveforms of substantially equal shapes are obtained. A reason why is conceivably that a bubble or a lump of ink having grown more viscous is so large that the ink is not emitted from the nozzle, or the ink having grown more viscous is solidified, resulting in that their positions or states hardly change because of the vibration.

As shown in FIG. 5B, on the other hand, the detected signals VOUT obtained by means of the fact that the driver element 417 corresponding to a failed emission nozzle is driven firstly and secondly are of differently shaped waveforms. As shown in FIG. 5B, e.g., while the first cycle T1 of the first detected signal VOUT is longer than a reference cycle Ts, the first cycle T1 of the second detected signal VOUT is shorter than the reference cycle Ts. Further, while the second cycle T2 of the first detected signal VOUT is shorter than the reference cycle Ts, the second cycle T2 of the second detected signal VOUT is longer than the reference cycle Ts. That is, the lengths of the cycles of the first and second detected signals VOUT corresponding to each other (e.g., the first cycles T1) are unequal, and the length of the first cycle T1 of each of the detected signals is different from the lengths of the following cycles T2, T3 and so on. That is, the cycles of the residual vibration caused by the failed emission nozzle vary in the lengths.

The detected signal VOUT (residual vibration) obtained by means of the fact that the driver element 417 corresponding to a failed emission nozzle is unsteady and varies, and waveforms of different shapes are obtained each time the driver element 417 is driven. A reason why is conceivably that a bubble or a lump of ink having grown more viscous is not so large, resulting in that their positions and states are likely to change because of the vibration.

Thus, according to the first embodiment, whether a malfunctioning nozzle is in the no emission state or in the failed emission state is decided on the basis of a variation in the cycles of the two detected signals VOUT by means of the fact that one and the same driver element 417 is driven twice. The test method of the first embodiment will be specifically explained below according to the flow shown in FIG. 6.

To begin with, the controller 10 selects one of nozzles #1-#180 belonging to a nozzle line to be tested and sets the selected one as a nozzle #n to be tested in condition that the nozzle aperture face of the head 41 faces the cap 44 in the home position. The nozzles are successively tested starting, e.g., from the first nozzle #1. Then, drive the driver element 417 corresponding to the nozzle #n to be tested by the emission waveform Wb (FIG. 3A) (S001). The controller 10 transmits the driving signal COM generated by the driving signal generator circuit 15 to the head controller 42 (FIG. 3B) for that, and transmits the pixel data SI to the head controller 42 so that the switch 424 in the head controller 42 corresponding to the nozzle #n to be tested is turned on (closed state) in the second period t2 in the reiteration cycle t. Incidentally, either one of the controller 10 and the printer driver may make the pixel data SI in time of the test. Further, the controller 10 sets the gate signal DSEL to the H level so as to turn on the switch 432 in the residual vibration detecting circuit 43 in the second period t2. The emission waveform Wb is resultantly applied to the driver element 417 corresponding to the nozzle #n to be tested. Incidentally, the switch 424 in the head controller 42 corresponding to a nozzle excepting the nozzle #n to be tested may be turned on in the first period t1 and the minute vibration waveform Wa is thereby applied to the driver element 417, so that the ink in the nozzle excepting the nozzle #n to be tested is prevented from growing more viscous.

After that, the controller 10 turns on the switch 424 in the head controller 42 corresponding to the nozzle #n to be tested in the third period t3 in the reiteration cycle t, and sets the gate signal DSEL to the L level so as to turn off the switch 432 in the residual vibration detecting circuit 43. Incidentally, only the switch 424 in the head controller 42 corresponding to the nozzle #n to be tested for which a residual vibration should be detected is turned on in the third period t3. The electromotive voltage of the driver element 417 (piezo-electric element 417*b*) caused by the residual vibration of the vibration board 416 remaining after the emission waveform Wb is applied, i.e., a voltage according to the residual vibration of the nozzle #n to be tested, is resultantly provided to the residual vibration detecting circuit 43 from the grounded end HGND and is amplified by the ac amplifier 431. The controller 10 obtains the detected signal VOUT provided by the residual vibration detecting circuit 43, and obtains the first cycle of the detected signal VOUT as a cycle Tc1 of the residual vibration of the nozzle #n to be tested (S002). Incidentally, the cycle of the residual vibration of the nozzle #n to be tested Tc1 is not limited to the first cycle of the detected signal VOUT, and may be one of the cycles following the first cycle.

If a bubble gets into the nozzle #n to be tested and thus causes malfunctioning emission as shown in FIG. 4A described above, the cycle of the residual vibration is shortened. If ink grows more viscous in the nozzle #n to be tested and thus causes malfunctioning emission, the cycle of the residual vibration is extended. Then, the controller 10 decides whether the cycle Tc1 detected from the residual vibration of the nozzle #n to be tested is within or out of a normal range by comparing the cycle Tc1 with thresholds D1 and D2. Incidentally, suppose that the thresholds D1 and D2 are preset according to ink characteristics and the waveform shape of the driving signal COM on the basis of the detected signals VOUT coming from normally working and malfunctioning nozzles.

Specifically, if the detected cycle Tc1 is larger than the first threshold D1 and smaller than the second threshold D2 (S003→YES), the controller 10 decides that the nozzle #n to be tested is free from malfunctioning ink emission and that the nozzle #n to be tested is normally working (S004). If the detected cycle Tc1 equals or is smaller than the first threshold D1, or equals or larger than the second threshold D2 in the opposite way (S003→NO), the controller 10 decides that a bubble having gotten into the nozzle #n to be tested or ink having grown more viscous has caused malfunctioning emission, and that the nozzle #n to be tested is malfunctioning (S005). After the test of the nozzle #n to be tested ends, the controller 10 sets an untested nozzle as a new nozzle #n to be tested and tests that. Then, the above process (S001-S006) is repeated until tests of all the nozzles #1-#180 belonging to the nozzle line to be tested end (S006→YES).

Then, the controller 10 decides whether the nozzle found to be malfunctioning by the first test (S001-S006) is either in the no emission state or in the failed emission state. To begin with, for that purpose, the controller 10 decides whether any of the nozzles is found to be malfunctioning as a result of the first test (S007). If no nozzle is found to be malfunctioning (S007→NO), the controller 10 ends the entire test.

If one or more nozzles are found to be malfunctioning (S007→YES), the controller 10 selects one of the nozzles found to be malfunctioning and sets the selected one as a nozzle #N to be tested, and drives a driver element 417 corresponding to the nozzle #N to be tested by the emission waveform Wb (S008). The controller 10 transmits the driving signal COM generated by the driving signal generator circuit 15 to the head controller 42 for that, turns on a switch 424 in the head controller 42 corresponding to the nozzle #N to be tested in the second period t2 in the reiteration cycle t, and sets the gate signal DSEL to the H level so as to turn on the switch 432 in the residual vibration detecting circuit 43. The emission waveform Wb is resultantly applied to the driver element 417 corresponding to the nozzle #N to be tested.

After that, the controller 10 turns on the switch 424 in the head controller 42 corresponding to the nozzle #N to be tested in the third period t3 in the reiteration cycle t, and sets the gate signal DSEL to the L level so as to turn off the switch 432 in the residual vibration detecting circuit 43. The electromotive voltage of the driver element 417 caused by the residual vibration of the vibration board 416 remaining after the emission waveform Wb is applied, i.e., a voltage according to the residual vibration of the nozzle #N to be tested, is resultantly provided to the residual vibration detecting circuit 43 from the grounded end HGND and is amplified by the ac amplifier 431. The controller 10 obtains the detected signal VOUT provided by the residual vibration detecting circuit 43, and obtains the first cycle of the detected signal VOUT as a cycle Tc2 of the residual vibration of the nozzle #N to be tested (S009).

Then, if the detected cycle Tc2 of the nozzle #N to be tested is within a normal range, i.e., if the detected cycle Tc2 is larger than the first threshold D1 and smaller than the second threshold D2 (S010→YES), the controller 10 changes the nozzle #N to be tested into a normally working nozzle (S015). A nozzle found to be a malfunctioning nozzle by the first test is sometimes found to be a normally working nozzle by the second test in this way. A reason why is, e.g., that a small bubble having mixed in time of the first test and caused malfunctioning emission disappears as time passes, or that a small amount of ink having grown more viscous and caused malfunctioning emission is discharged from the nozzle in time of the first test.

Meanwhile, if the detected cycle Tc2 equals or is smaller than the first threshold D1, or equals or larger than the second threshold D2 (S010→NO), the controller 10 decides that the nozzle #N to be tested is malfunctioning. Then, the controller 10 obtains a variation σ in the cycles of the detected signals VOUT obtained by means of the fact that the driver element 417 corresponding to the nozzle #N to be tested is driven for the first time (S001) and the next time (S008) (5011). Suppose, as to the embodiment, that a standard deviation of the first to fifth cycles T1-T5 of the detected signal VOUT obtained by the first driving and the first to fifth cycles T1-T5 of the detected signal VOUT obtained by the second driving (i.e., standard deviation of ten cycles) is chosen as the variation σ in the cycles.

While the residual vibration caused by the no emission nozzle (FIG. 5A) is steady and shows no variation in the cycles, the residual vibration caused by the failed emission nozzle (FIG. 5B) is unsteady and shows a variation in the cycles as described above. Thus, the controller 10 compares the variation σ in the cycles in the residual vibration of the nozzle #N to be tested with a third threshold D3 (which corresponds to a first threshold). If the variation σ in the cycles is larger than the third threshold D3 (S012→YES), the controller 10 decides that the nozzle #N to be tested is a failed emission nozzle (S013). If the variation σ in the cycles equals or is smaller than the third threshold D3 (S012→NO), the controller 10 decides that the nozzle #N to be tested is a no emission nozzle (S014). Incidentally, suppose that the third threshold D3 is preset on the basis of the detected signals VOUT of no emission and failed emission nozzles.

Incidentally, although choosing the standard deviation of the five cycles T1-T5 of the detected signals VOUT for the first and second times as the variation σ in the cycles, that choice is not limited to the above, and a standard deviation of more than or less than five cycles may be chosen as the variation σ in the cycles, or the number of cycles used for calculation of the variation σ in the detected signal VOUT for the first time may differ from that in the detected signal VOUT for the second time. Further, the variation σ in the cycles is not limited to a standard deviation, and may be anything which represents the variation σ in the cycles. For example, if a difference (absolute value) between each of the five cycles T1-T5 of the detected signals VOUT for the first and second times and the reference cycle Ts is calculated, a sum of the differences may be chosen as the variation σ in the cycles. Further, e.g., if plural differences of the cycles of the detected signals VOUT for the first and second times corresponding to each other (e.g., the first cycles T1 of both, or the second cycles T2 of both) are calculated, a sum of the differences may be chosen as the variation σ in the cycles. In those cases, the controller 10 can decide as well that the nozzle to be tested is a failed emission nozzle if the variation σ in the cycles is larger than the threshold, and that it is a no emission nozzle if the variation equals or is smaller than the threshold.

If the nozzle #N to be tested is a malfunctioning nozzle, it is decided whether the nozzle #N to be tested is either in the no emission state or in the failed emission state on the basis of the variation σ in the cycles of the two detected signals VOUT obtained by means of the fact that the driver element 417 is driven twice in this way. The controller 10 repeats the above process (S008-S016) until running the second test for all the nozzles found to be malfunctioning by the first test (S016→YES).

According to the first embodiment, as described above, the controller 10 (controller) drives one and the same driver element 417 plural times (herein, twice) so as to obtain plural detected signals VOUT, and decides whether the state of malfunctioning ink emission that the nozzle corresponding to the driver element 417 is in is either the state of no ink emission where no ink is emitted or the state of failed ink emission where ink is emitted although irregularly on the basis of the obtained detected signals VOUT. Incidentally, even if the ink grows more viscous or a bubble mixes not in the nozzle Nz but in the ink supply outlet 413 or the pressure chamber 411, the angular velocity ω changes in the calculation model. Thus, to decide whether the nozzle to be tested is in the no emission state or in the failed emission state is not only to decide whether the ink has grown more viscous or a bubble has mixed in the nozzle Nz, but includes to decide whether the ink has grown more viscous or a bubble has mixed in the ink supply outlet 413 or in the pressure chamber 411.

Specifically, the controller 10 decides whether the nozzle is either in the no emission state or in the failed emission state by comparing the variation σ in the cycles of the respective detected signals VOUT obtained by means of the fact that one and the same driver element 417 is driven plural times with the third threshold D3 (which corresponds to the first threshold). The controller 10 described herein decides that the nozzle is in the no emission state if the variation σ in the cycles of the detected signals VOUT equals or is smaller than the third threshold D3, and decides that the nozzle is in the failed emission state if the variation σ in the cycles of the detected signals VOUT is larger than the third threshold D3.

That is, the printing system of the first embodiment not only detects a malfunctioning nozzle but identifies to what extent the malfunctioning nozzle malfunctions, and tests the state in which the malfunctioning nozzle is in detail. Incidentally, how to compare the variation σ in the cycles with the third threshold D3 is not limited to the above. It may be decided, e.g., that the nozzle is in the no emission state if the variation σ is smaller than the threshold, and that the nozzle is in the failed emission state if the variation σ equals or is larger than the threshold. Further, how to calculate the variation in the cycles and the threshold may be suitably set so that either one of the compared values is larger or smaller may be exchanged, and the state may be decided according to the comparison between the variation and the threshold.

Thus, a process according to the extent to which the malfunctioning nozzle malfunctions can be run according to the first embodiment. If, e.g., a no emission nozzle is detected, a cleaning process (e.g., pump absorption process or flashing process) is performed for the head 41. Meanwhile, if only a failed emission nozzle is detected, the failed emission nozzle is stopped from being used for a certain period of time. That is, printing is interrupted for a certain period of time, or pixel data SI having been allotted to the failed emission nozzle is allotted to another nozzle. A bubble thereby disappears in the period of time for which the failed emission nozzle is stopped from being used, and the failed emission nozzle can be made recover to a normally working nozzle. The malfunctioning nozzle can thereby be prevented from degrading quality of a printed image. Further, if only a failed emission nozzle is detected, an amount of ink used for the cleaning process can be reduced.

Further, if only a failed emission nozzle is detected, time for the cleaning process for the head 41 can be made shorter than that in a case where a no emission nozzle is detected. That is, strength of the cleaning process can be adjusted according to the extent to which the nozzle malfunctions, so that the amount of ink used for the cleaning process can be reduced.

Further, a limit value may be set to how many times ink is emitted or time of use until the failed emission nozzle turns to be no emission one. Then, if a no emission nozzle is detected, use of the nozzle is immediately stopped or a cleaning process is run. Meanwhile, if a failed emission nozzle is detected, printing may be continued until the limit value is exceeded, and the use of the failed emission nozzle is stopped or the cleaning process is run when the limit value is exceeded.

Further, the failed emission nozzle causes degradation in image quality not as much as the no emission nozzle does. Thus, if a failed emission nozzle is detected, the printing system may notify a user of the detection so that the user can choose whether printing is continued or shifted to the cleaning process. Printing speed may thereby be given priority over image quality, or image quality may be given priority over printing speed, according to conditions of the user.

Further, if a failed emission nozzle is detected, it is preferable to notify the user of the detection. As ink is emitted from the nozzle found to be malfunctioning (failed emission nozzle), a user's misunderstanding that the test is not correctly run can thereby be prevented.

Further, after the controller 10 of the first embodiment obtains a detected signal VOUT by driving the driver element 417 and decides whether the nozzle corresponding to the driver element 417 causes malfunctioning ink emission on the basis of the detected signal VOUT, the controller 10 drives again the driver element 417 corresponding to the malfunctioning nozzle causing malfunctioning ink emission, and does not drive a driver element 417 corresponding to a normally working nozzle causing no malfunctioning ink emission. That is, the controller 10 runs the second test only for the nozzle found to be malfunctioning by the first test. The controller 10 obtains plural detected signals VOUT as to a malfunctioning nozzle for which the extent that the nozzle malfunctions to needs to be decided, and does not obtain plural detected signals VOUT as to a normally working nozzle for which the extent that the nozzle malfunctions to does not need to be decided, so that time for the overall test can be shortened and the amount of ink used for the test can be reduced.

Further, a malfunctioning nozzle is likely to change in its state, as a bubble or ink having grown more viscous is discharged from the nozzle with an ink drop while the test is being run, or the bubble in the ink disappears. Thus, it is preferable to decide again whether the nozzle #N to be tested is malfunctioning or not on the basis of the detected signal VOUT obtained by the second test (S010 in FIG. 6). That is, a malfunctioning nozzle which is likely to change in its state can be more precisely detected by means of the tests run twice. A normally working nozzle can be prevented from being wrongly found to be malfunctioning, and a user's misunderstanding that the test is not correctly run can be prevented.

Further, the controller 10 of the first embodiment decides to what extent a malfunctioning nozzle malfunctions on the basis of the variation σ in the cycles of the detected signals VOUT. The basis of the decision is not limited to the above, and the controller 10 may decide to what extent a malfunctioning nozzle malfunctions on the basis of another variation of plural detected signals VOUT obtained by means of the fact that the same driver element 417 is driven plural times.

As to residual vibrations caused by a failed emission nozzle (FIG. 5B), the first and second detected signals VOUT substantially equal in the initial amplitudes (a1=~a3, a2=~a4), and vary in the later amplitudes. Incidentally, the amplitudes are differences in voltage between the reference voltage V0 and the maximum (to which the voltage rises and from which the voltage falls), between the reference voltage V0 and the minimum (to which the voltage falls and from which the voltage rises), or between the minimum and the maximum. Thus, e.g., a variation (e.g., standard deviation) in the amplitudes in the respective cycles from the second cycle T2 to the fifth cycle T5 of the first and second detected signals VOUT may be chosen as the variation in the detected signal VOUT, so that the controller 10 may decided to what extent a malfunctioning nozzle malfunctions.

Further, in the residual vibration that the failed emission nozzle causes (FIG. 5B), how many maxima and minima are included in each of the corresponding cycles is different between the first and second detected signals VOUT (e.g., first cycles T1 of both, second cycles T2 of both). Thus, e.g., plural differences of the numbers of the maxima and the minima in the corresponding cycles may be calculated between the first and second detected signals VOUT, so that a sum of the plural differences may be chosen as the variation in the detected signal VOUT and to what extent the malfunctioning nozzle malfunctions may be decided.

Second Embodiment

Test Method

Figure 7:
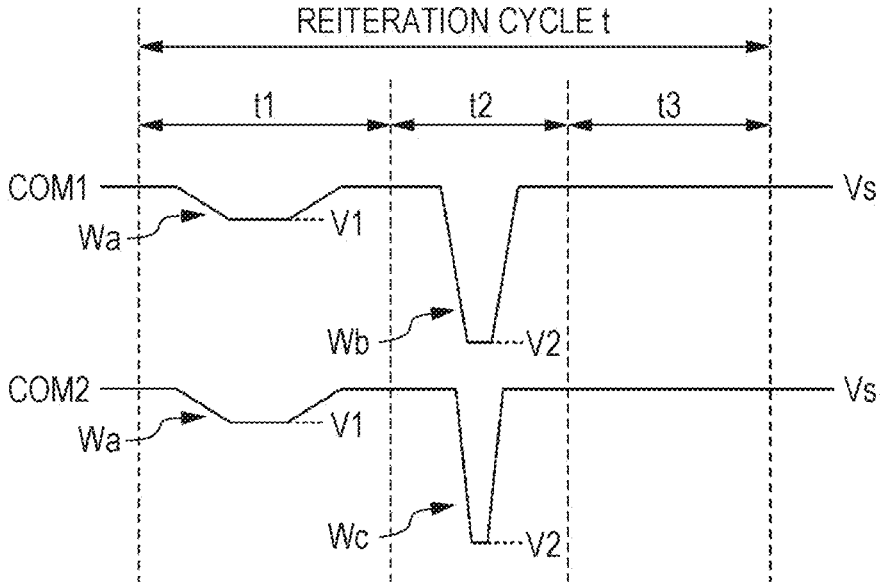
FIG. 7 illustrates driving signals COM1 and COM2 to be used for a second embodiment.
Figure 8A:
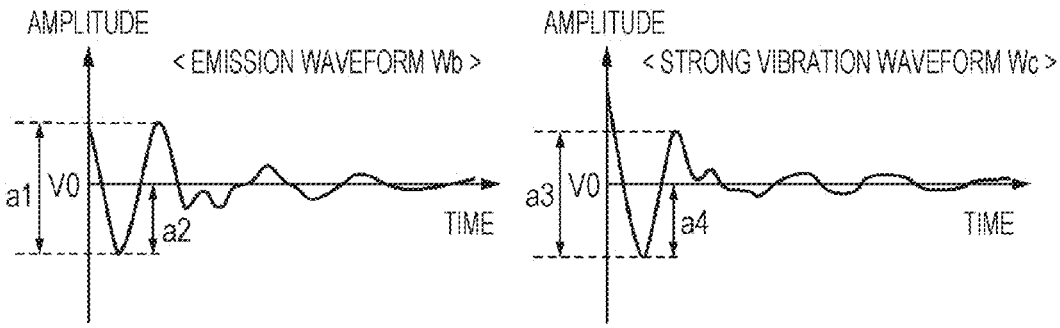
FIG. 8A shows a residual vibration of a failed emission nozzle.
Figure 8B:
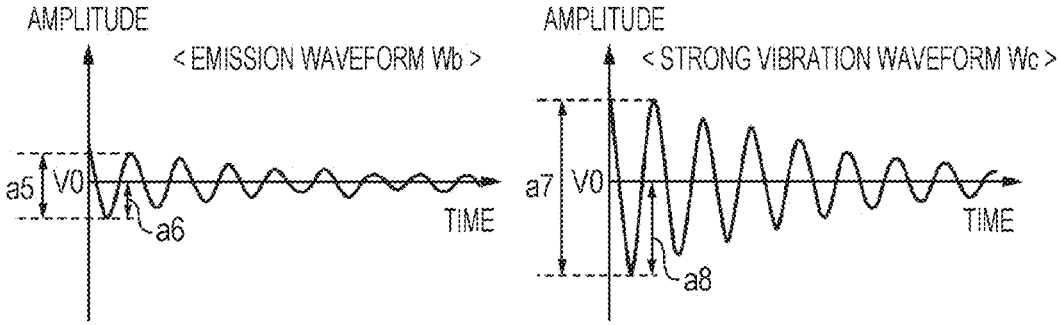
FIG. 8B shows a residual vibration of a no emission nozzle.
Figure 9:
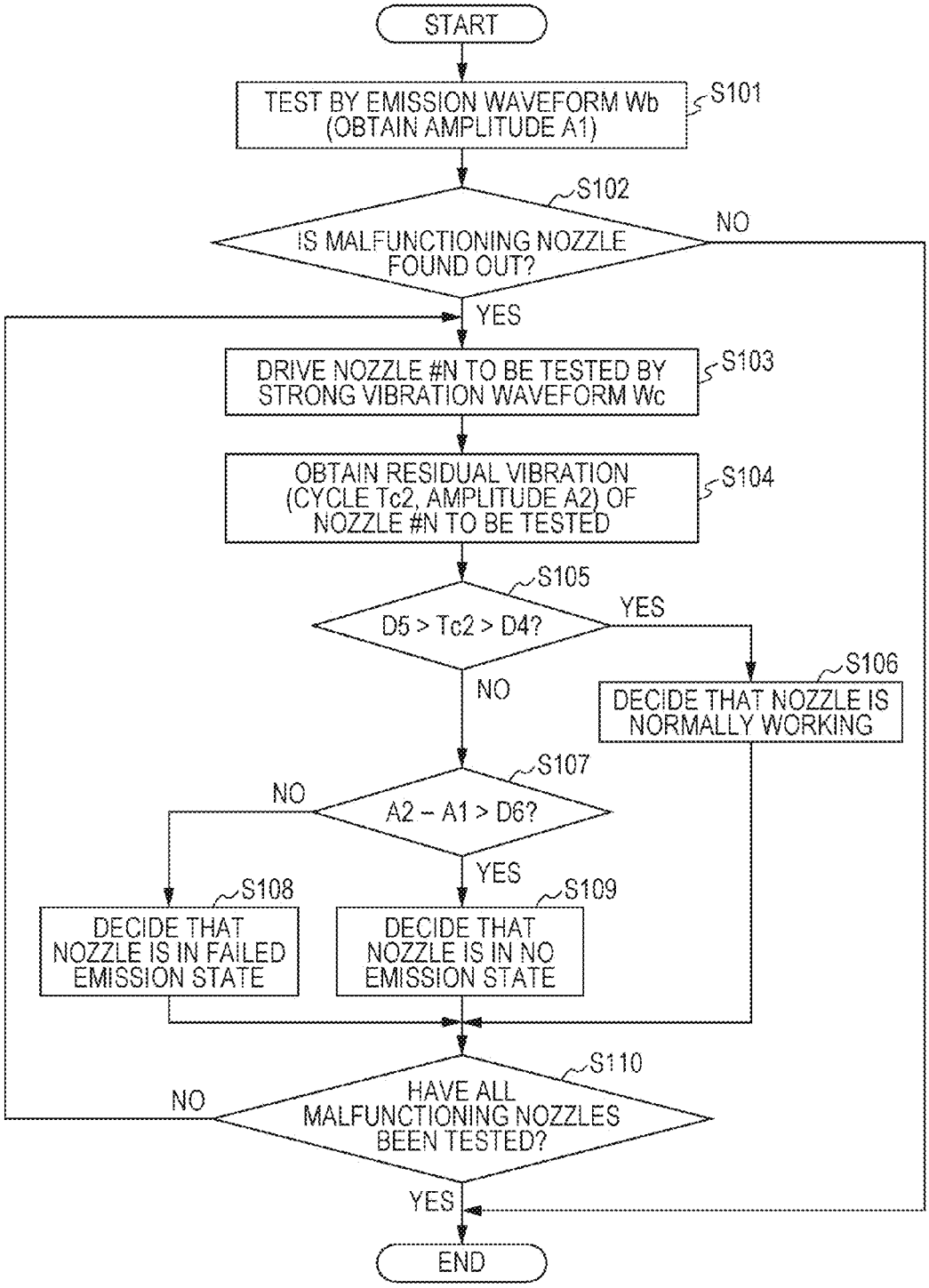
FIG. 9 shows a flow of a test method of the second embodiment.

FIG. 7 illustrates driving signals COM1 and COM2 to be used for a second embodiment. FIG. 8A illustrates an exemplary waveform of a residual vibration caused by a failed emission nozzle. FIG. 8B illustrates an exemplary waveform of a residual vibration caused by a no emission nozzle. FIG. 9 illustrates a flow of a test method of the second embodiment. According to the second embodiment, the driving signal generator circuit 15 generates two kinds of the driving signals COM1 and COM2. The first driving signal COM1 includes a minute vibration waveform Wa generated in a first period t1, a emission waveform Wb generated in a second period t2, and a waiting voltage Vs held in a third period t3. The second driving signal COM2 includes the minute vibration waveform Wa generated in the first period t1, a strong vibration waveform We generated in the second period t2, and the waiting voltage Vs held in the third period t3.

The strong vibration waveform Wc makes the pressure chamber 411 expand by means of a waveform portion dropping from the waiting voltage Vs to the second voltage V2, and makes the pressure chamber 411 contract by means of a waveform portion rising from the second voltage V2 to the waiting voltage Vs, so as to make the ink in the pressure chamber 411 change in pressure, similarly as the emission waveform Wb does. Inclinations of the waveform portions are steeper in the strong vibration waveform Wc than in the emission waveform Wb, though. That is, a magnitude of the change in voltage per a unit length of time is larger. Thus, the strong vibration waveform Wc can drive the driver element 417 more vigorously and can make the ink in the pressure chamber 411 change in pressure more vigorously, than the emission waveform Wb does. Thus, residual vibrations which occur afterwards in the pressure chamber 411 (vibration board 416) or in the ink in the pressure chamber 411 turn larger, and a residual vibration on the driver element 417 through which the residual vibration of the vibration board 416 is transferred turns larger as well. That is, the strong vibration waveform Wc is a waveform which can provide the vibration board 416, the driver element 417, etc., with more powerful vibrating force than the emission waveform Wb does.

Incidentally, according to the embodiment, the inclinations of the waveform portion for making the pressure chamber 411 expand and contract are made steep so that the vibrating force of the strong vibration waveform Wc is made powerful, and the embodiment is not limited by the above. The magnitude of the change in voltage may be made larger in the strong vibration waveform Wc than in the emission waveform Wb, e.g., so that the vibrating force of the strong vibration waveform Wc is made more powerful.

FIG. 8A illustrates a waveform of a residual vibration obtained by means of the fact that a driver element 417 corresponding to a failed emission nozzle is driven by the emission waveform Wb on the left hand side, and illustrates a waveform of a residual vibration obtained by means of the fact that the driver element 417 corresponding to the failed emission nozzle is driven by the strong vibration waveform Wc on the right hand side. FIG. 8B illustrates a waveform of a residual vibration obtained by means of the fact that a driver element 417 corresponding to a no emission nozzle is driven by the emission waveform Wb on the left hand side, and illustrates a waveform of a residual vibration obtained by means of the fact that the driver element 417 corresponding to the no emission nozzle is driven by the strong vibration waveform Wc on the right hand side.

As to the residual vibrations caused by the failed emission nozzle (FIG. 8A), although the waveforms are different in their shapes in cases where the driver element 417 is driven by the emission waveform Wb and by the strong vibration waveform Wc, it is resultantly known that the respective detected voltages VOUT do not differ much in the initial amplitudes (a1=~a3, a2=~a4). As to the residual vibrations caused by the no emission nozzle (FIG. 8B), on the other hand, it is resultantly known that the initial amplitudes (a8 and a7) in the detected signal VOUT in case of being driven by the strong vibration waveform Wc is larger than the initial amplitudes (a6 and a5) in the detected signal VOUT in case of being driven by the emission waveform Wb (a6<a8, a5<a7).

A reason why is conceivably as follows. As ink is emitted from the failed emission nozzle and thus the pressure in the pressure chamber 411 decreases as the ink is emitted, the amplitudes do not change between being driven by the emission waveform Wb and being driven by the strong vibration waveform Wc. As no ink is emitted from the no emission nozzle, on the other hand, the ink emission does not cause the pressure to be lost and the amplitudes grow by means of the fact of being driven by the strong vibration waveform Wc. Further, if a bubble having mixed causes no ink emission, the bubble grows by means of the fact that the driver element 417 is driven by the strong vibration waveform Wc and thus the amplitudes conceivably grow within a short path of the ink flow.

According to the second embodiment, then, it is decided whether a malfunctioning nozzle is either in the no emission state or in the failed emission state on the basis of a detected signal VOUT obtained by means of the fact that the driver element 417 is driven by the emission waveform Wb and a detected signal VOUT obtained by means of the fact that the driver element 417 is driven by the strong vibration waveform Wc. The test method of the second embodiment will be specifically explained below according to the flow shown in FIG. 9.

To begin with, the controller 10 drives the driver elements 417 each corresponding to each of all the nozzles #1-#180 belonging to a nozzle line to be tested by the emission waveform Wb in turn so as to decide whether the nozzles are each malfunctioning or not (first test) (S101), similarly as to the first embodiment (S001-S006 in FIG. 6). That is, if a detected cycle Tc1 of a residual vibration obtained by application of the emission waveform Wb to a driver element 417 corresponding to a nozzle #n to be tested is larger than the first threshold D1 and smaller than the second threshold D2, the controller 10 decides that the nozzle #n to be tested is normally working. If the detected cycle Tc1 is within a range excepting the above, the controller 10 decides that the nozzle #n to be tested is malfunctioning.

Incidentally, the controller 10 obtains an amplitude A1 of the residual vibration of the nozzle found to be malfunctioning as a result of the first test by the emission waveform Wb so as to be ready for the second test. Suppose, as to the embodiment, that a voltage difference between the initial minimum of the detected signal VOUT and the reference voltage V0 (e.g., a2 in FIG. 8A) is the amplitude. The embodiment is not limited by the above, though, and a voltage difference between the first maximum of the detected signal VOUT and the reference voltage V0 may be the amplitude, e.g., or a voltage difference between the highest and lowest voltages of the detected signal VOUT (e.g., a1 in FIG. 8A) may be the amplitude.

Then, the controller 10 decides whether any of the nozzles is found to be malfunctioning as a result of the first test by the emission waveform Wb (S102). If no nozzle is found to be malfunctioning (S102→NO), the controller 10 ends the entire test. Meanwhile, if one or more nozzles are found to be malfunctioning (S102→YES), the controller 10 selects one of the nozzles found to be malfunctioning by the first test and sets the selected one as a nozzle #N to be tested, and then drives a driver element 417 corresponding to the nozzle #N to be tested by the strong vibration waveform Wc (S103). The controller 10 transmits the driving signal COM generated by the driving signal generator circuit 15 to the head controller 42 for that, turns on a switch 424 in the head controller 42 corresponding to the nozzle #N to be tested in the second period t2 in the reiteration cycle t, and sets the gate signal to the H level so as to turn on the switch 432 in the residual vibration detecting circuit 43. The strong vibration waveform Wc is resultantly applied to the driver element 417 corresponding to the nozzle #N to be tested.

After that, the controller 10 turns on the switch 424 in the head controller 42 corresponding to the nozzle #n to be tested in the third period t3 in the reiteration cycle t, and sets the gate signal DSEL to the L level so as to turn off the switch 432 in the residual vibration detecting circuit 43. The electromotive voltage of the driver element 417 (piezo-electric element 417*b*) caused by the residual vibration of the vibration board 416 remaining after the strong vibration waveform Wc is applied, i.e., a voltage according to the residual vibration of the nozzle #N to be tested, is resultantly provided to the residual vibration detecting circuit 43 from the grounded end HGND and is amplified by the ac amplifier 431. The controller 10 obtains the detected signal VOUT provided by the residual vibration detecting circuit 43, and obtains a cycle (herein, the initial cycle) of the detected signal VOUT as a cycle Tc2 of the residual vibration of the nozzle #N to be tested, and further obtains the amplitude of the detected signal VOUT (herein, the voltage difference between the first minimum and the reference voltage V0) as the amplitude A2 of the residual vibration of the nozzle #N to be tested (S104).

Then, if the detected cycle Tc2 detected from the residual vibration of the nozzle #N to be tested is larger than a fourth threshold D4 and smaller than a fifth threshold D5 (S105→YES), the controller 10 changes the nozzle #N to be tested into a normally working nozzle (S106). A nozzle found to be a malfunctioning nozzle by the first test is sometimes found to be a normally working nozzle by the second test in this way. Incidentally, if the cycles of the residual vibrations differ from each other in cases where the emission waveform Wb is applied and the strong vibration waveform We is applied even if the states of the nozzle Nz does not change, it is preferable to make the thresholds to be used for the decision (D1, D2 and D4, D5) differ from one another.

Meanwhile, if the detected cycle Tc2 equals or is smaller than the fourth threshold D4, or equals or larger than the fifth threshold D5 (S105→NO), the controller 10 decides that the nozzle #N to be tested is malfunctioning. Then, the controller 10 compares a difference between the amplitude A1 of the residual vibration of the nozzle #N to be tested obtained by the first test run by the emission waveform Wb and the amplitude A2 of the residual vibration of the nozzle #N to be tested obtained by the second test run by the strong vibration waveform Wc (A2−A1) with a sixth threshold D6 (which corresponds to a second threshold) (S107).

Then, if the amplitude difference (A2−A1) is larger than the sixth threshold D6 (S107→YES), the controller 10 decides that the nozzle #N to be tested is a no emission nozzle as shown in FIG. 8B (S109). If the amplitude difference equals or is smaller than the sixth threshold D6 (S107→NO), the controller 10 decides that the nozzle #N to be tested is a failed emission nozzle as shown in FIG. 8A (S108). The controller 10 decides to what extent a malfunctioning nozzle malfunctions on the basis of the difference between the amplitude A1 of the detected signal VOUT caused by the emission waveform Wb and the amplitude A2 of the detected signal VOUT caused by the strong vibration waveform Wc (A2−A1). Then, the above process (S103-S110) is repeated until the second test by the strong vibration waveform Wc is run for all the nozzles found to be malfunctioning by the first test according to the emission waveform Wb (S110→YES).

The controller 10 of the second embodiment drives the driver element 417 in such a way as to provide vibrating force (first vibrating force) by applying the emission waveform Wb so as to obtain a detected signal VOUT (first detected signal), and drives the driver element 417 in such a way as to provide vibrating force (second vibrating force) which is more powerful than that in time of the test run by the emission waveform Wb by applying the strong vibration waveform We so as to obtain a detected signal VOUT (second detected signal). The controller 10 decides whether the malfunctioning nozzle corresponding to the relevant driver element 417 is either in the no emission state or in the failed emission state on the basis of the first and second detected signals VOUT as described above. Incidentally, to decide the state that the nozzle to be tested is in is not only to decide whether the ink has grown more viscous in or a bubble has gotten into the nozzle Nz, but includes to decide whether the ink has grown more viscous or a bubble has mixed in the ink supply outlet 413 or in the pressure chamber 411.

Specifically, the controller 10 compares the amplitude difference between the detected signal VOUT obtained by the application of the emission waveform Wb and the detected signal VOUT obtained by the application of the strong vibration waveform Wc with the sixth threshold D6 (which corresponds to a second threshold), and decides whether the nozzle is either in the no emission state or in the failed emission state. The controller 10 decides herein that the malfunctioning nozzle is in the no emission state if the difference between the amplitude A1 of the detected signal VOUT (first detected signal) obtained by means of the fact that the driver element 417 is driven by the emission waveform Wb and the amplitude A2 of the detected signal VOUT (second detected signal) obtained by means of the fact that the driver element 417 is driven by the strong vibration waveform Wc is larger than the sixth threshold D6. The controller 10 decides that the malfunctioning nozzle is in the failed emission state if the difference between the amplitudes A1 and A2 equals or smaller than the sixth threshold D6. Incidentally, how the difference between the amplitudes A1 and A2 is compared with the threshold D is not limited to the above. The controller 10 may decide the no emission state, e.g., if the difference between the amplitudes A1 and A2 equals or is larger than the threshold. Further, the controller 10 may decide the failed emission state if the difference between the amplitudes A1 and A2 is smaller than the threshold. Further, how to calculate the amplitudes A1, A2, their difference and the threshold are suitably set so that either one of the compared values is larger or smaller may be exchanged, and the state may be decided according to the comparison between the amplitude difference and the threshold.

As not only detecting a malfunctioning nozzle but identifying to what extent the malfunctioning nozzle malfunctions, the printing system of the second embodiment can run a process according to the extent to which the nozzle malfunctions as explained as to the first embodiment. If, e.g., a no emission nozzle is detected, it is preferable to run a cleaning process for the head 41. Meanwhile, if a failed emission nozzle is detected, it is preferable to stop using the failed emission nozzle for a certain period of time.

Incidentally, the emission waveform Wb is used when an image is printed on the medium S. Thus, an inclination of a waveform portion that the emission waveform Wb has is set relatively gentle so that a specified amount of ink is consecutively and steadily emitted from the nozzle Nz, i.e., vibration of the meniscus in the nozzle Nz is limited when the next reiteration cycle t begins even after an ink drop is emitted from the nozzle Nz. Thus, if the driver element 417 is driven by the emission waveform Wb, the driver element 417 is driven slowly and the ink in the pressure chamber 411 slowly changes in pressure. Thus, the residual vibration occurring in the pressure chamber 411 (vibration board 416) or the ink in the pressure chamber 411 is relatively small. If the residual vibration occurring on the vibration board 416, etc., is small, the electromotive voltage of the driver element 417 turns small, resulting in that the voltage level of the detected signal VOUT provided by the residual vibration detecting circuit 43 turns small as well.

Thus, the driver element 417 is driven in such a way that, if a test according to the strong vibration waveform We is run for a normally working nozzle which does not cause malfunctioning ink emission by the ordinary test according to the emission waveform Wb, vibrating force which makes ink emission from the normally working nozzle unsteady is provided. Incidentally, unsteady ink emission is that, although ink is emitted from the nozzle, e.g., a specified amount of ink is not emitted in every reiteration cycle t, or an ink drop reaches a wrong position excepting a target position. That is, the driver element 417 is driven in such a way that vibrating force which is more powerful than that in time of printing is provided in the second test. The residual vibrations occurring in the pressure chamber 411 (vibration board 416) or the ink in the pressure chamber 411 thereby grows large, and so do the electromotive voltage of the driver element 417 which occurs according to the residual vibration and the voltage level of the detected signal VOUT provided by the residual vibration detecting circuit 43. The residual vibrations can thereby be analyzed in detail in the second test according to the strong vibration waveform Wc, and the detected signal VOUT can be made less sensitive to noise.

Thus, it is preferable to decide again whether the nozzle #N to be tested is a normally working nozzle or not on the basis of the detected signal VOUT obtained by the second test according to the strong vibration waveform Wc (S105 in FIG. 9). The malfunctioning nozzle whose state is likely to change can thereby be more precisely tested. Further, a normally working nozzle can be prevented from being wrongly found to be malfunctioning, and a user's misunderstanding that the test is not correctly run can be prevented.

Meanwhile, if the strong vibration waveform Wc is applied to the driver element 417, e.g., a bubble in the pressure chamber 411 may possibly grow larger or the bubble may be involved, etc., resulting in that matters may possibly worsen. Thus, after deciding whether the nozzle corresponding to the driver element 417 causes malfunctioning ink emission or not on the basis of the detected signal obtained by driving the driver element 417 by the emission waveform Wb, drive again the driver element 417 corresponding to the malfunctioning nozzle causing malfunctioning ink emission by the strong vibration waveform Wc, but do not drive the driver element 417 corresponding a nozzle causing no ink emission by the strong vibration waveform Wc. Time for the overall test can thereby be shortened, and the number of nozzles in which matters may possibly worsen upon being driven by the strong vibration waveform Wc can be reduced.

Modifications

First Modification

The controller 10 of the first embodiment decides to what extent the malfunctioning nozzle malfunctions on the basis of the variation σ in the cycles of the two detected signals VOUT, and the controller 10 of the second embodiment decides to what extent the malfunctioning nozzle malfunctions on the basis of the difference between the amplitudes A1 and A2 of the two detected signals VOUT. The invention is not limited by the above. The controller 10 may drive the driver element 417 by the emission waveform Wb and the strong vibration waveform Wc so as to obtain two detected signals VOUT, and may decide to what extent the malfunctioning nozzle malfunctions on the basis of two parameters which are the variation σ in the cycles and the difference between the amplitudes A1 and A2 of the two detected signals VOUT.

Second Modification

Although only the driver element 417 corresponding to the nozzle found out to be malfunctioning by the first test is again driven according to the above embodiments, the invention is not limited by the above. For example, a driver element 417 corresponding to a nozzle found to be normally working by the first test may be driven again. In this case, the controller 10 can detect a normally working nozzle more precisely by deciding whether a nozzle is normally working or not on the basis of plural detected signals VOUT. Further, how many times the driver element 417 is driven is not limited to two, and the controller 10 may decide to what extent a malfunctioning nozzle malfunctions on the basis of three or more detected signals VOUT obtained by driving the driver element 417 three or more times.

Third Modification

Although the controller 10 of the first embodiment drives the driver element 417 by the emission waveform Wb plural times (twice), the invention is not limited by the above. The controller 10 may decide to what extent a malfunctioning nozzle malfunctions on the basis of detected signals VOUT obtained by driving the driver element 417, e.g., by the minute vibration waveform Wa plural times. Further, although the controller 10 of the second embodiment drives the driver element 417 by the emission waveform Wb and the strong vibration waveform Wc in such a way that the vibrating force applied to the driver element 417 changes, the invention is not limited by the above. The controller 10 may drive the driver element 417, e.g., by the minute vibration waveform Wa and the emission waveform Wb, or by the minute vibration waveform Wa and the strong vibration waveform Wc. Further, as a waveform for forming a larger dot can provide more powerful vibrating force in general, the controller 10 may drive the driver element 417, e.g., by waveforms for forming a small dot and a large dot.

Fourth Modification

The controller 10 of the above embodiments tests the nozzles while printing is not being done. The invention is not limited by that, and the controller 10 may run the test while printing is being done. If the test is run only by the use of the emission waveform Wb to be used for printing similarly as the first embodiment, it is preferable to test the nozzle to be tested in a reiteration cycle t in which the pixel data SI[1] to form a dot is allotted to the nozzle to be tested. Meanwhile, the nozzle may be tested by the minute vibration waveform Wa or by the emission waveform Wb according to the pixel data SI allotted to the nozzle to be tested. Ink emission to a pixel on which no dot should be formed can thereby be avoided. Further, if a test is run by the use of the strong vibration waveform Wc not to be used for printing similarly as the second embodiment, it is preferable to run the test, e.g., at timing when the head 41 returns to the home position (in which no printing is done).

Fifth Modification

Although the controller 10 of the above embodiments does not identify what has caused malfunctioning ink emission caused by the malfunctioning nozzle, the invention is not limited by that. As shown in FIG. 4A, e.g., the cycle is likely to be short for a no emission nozzle caused by the bubble having mixed, and to be long for a no emission nozzle caused by the ink having grown more viscous. Thus, e.g., the controller 10 may identify the cause for the malfunctioning emission as the bubble having mixed if the cycle of the detected signal VOUT of the no emission nozzle equals or is smaller than the first threshold D1, and may identify the cause for the malfunctioning emission as the ink having grown more viscous if the cycle of the detected signal VOUT of the no emission nozzle equals or is larger than the second threshold D2. Incidentally, the cause for a malfunctioning nozzle is not limited to the ink having grown more viscous or the bubble having mixed. The controller 10 may identify other causes such as adhesion of a foreign substance (paper powder, dust) to the nozzle on the basis of the detected signal VOUT.

The controller 10 can perform processing according to the cause for the malfunctioning emission not only by detecting the malfunctioning nozzle but by identifying the cause for the malfunctioning emission. Suppose, e.g., that a pump absorption process which consumes lots of ink needs to be performed in order to make a no emission nozzle caused by a bubble having mixed recover, and that a no emission nozzle caused by ink having grown more viscous can be made recover by a flashing process which does not consume much ink. In this case, it is preferable to perform the pump absorption process if a no emission nozzle caused by a bubble having mixed is detected, and to perform the flashing process if a no emission nozzle caused by only ink having grown more viscous is detected. The no emission nozzle can thereby be made recover to a normally working nozzle while controlling ink consumption.

Sixth Modification

Although the controller 10 of the above embodiments decides whether a nozzle is malfunctioning or not on the basis of the cycle of the residual vibration, the invention is not limited by that. The controller 10 may decide whether a nozzle is malfunctioning or not on the basis of another parameter such as the phase, amplitude, attenuation, etc., of the residual vibration. The controller 10 may combine plural parameters from the cycle, phase, amplitude, attenuation, etc., of the residual vibration so as to decide whether a nozzle is malfunctioning or not. Further, the controller 10 may decide whether a nozzle is malfunctioning or not on the basis of a change in cycles or amplitudes of the residual vibration.

Seventh Modification

The residual vibration detecting circuit 43 of the above embodiments detects the residual vibration remaining after the ink in the pressure chamber 411 changes in pressure by being driven by the driver element 417 as a change in the electromotive power caused by the mechanical displacement of the driver element 417 (piezo-electric element). That is, the driver element 417 is used for the test of the nozzle, which does not limit the invention, though. For example, a sensor to detect a vibration which occurred in the ink in the pressure chamber 411 by means of the fact that the driver element 417 is driven may be provided to the printer 1. For example, a sensor (e.g., pressure sensor) to sense a vibration (e.g., change in pressure) caused in the ink in the pressure chamber 411 may be provided in the pressure chamber 411 or in the ink supply outlet 413. In this case, not only the residual vibration remaining after the driver element 417 is driven is detected, but, e.g., a vibration may be detected at the same time as the driver element 417 is driven, or vibration may be detected while the driver element 417 is being driven or before being driven. Further, in this case, a thermal system to generate a bubble in the nozzle by using a heating element and to emit ink by the bubble may be used so that an ink drop is emitted from the nozzle.

Other Embodiments

The above embodiments are to make the invention comprehensible enough, and not to limit the invention for interpretation. It goes without saying that the invention can be changed or improved within the scope of it, and that the invention includes its equivalents.

The above embodiments are exemplified by the printer which alternately repeats an operation to emit ink while moving the head in the moving direction and an operation to transport the medium in the transport direction, which does not limit the invention, though. A printer such that a head emits ink to a medium when the medium passes below the fixed head including nozzles forming a line in a width direction of the medium and in a direction crossing the width direction, e.g., will do. A printer which prints an image by repeating an operation to print the image on a medium transported to a printing area while moving a head in an X-direction and an operation to move the head in a Y-direction, and then transports a portion of the medium where no image is printed yet to the printing area, e.g., will do.

The above embodiments are exemplified by the ink jet printer, an exemplary liquid emission apparatus, which does not limit the invention, though. Technologies similar to those of the above embodiments may be applied to various kinds of liquid emission apparatus which employ the ink jet technology, such as a color filter manufacturing apparatus, a dyeing apparatus, a micromachining apparatus, a semiconductor manufacturing apparatus, a surface finishing apparatus, a 3D forming apparatus, an evaporation apparatus, an organic EL manufacturing apparatus (macromolecular EL manufacturing apparatus, in particular), a display manufacturing apparatus, a membrane forming apparatus, a DNA chip manufacturing apparatus, etc.

The entire disclosure of Japanese Patent Application No. 2012-112217, filed May 16, 2012 is expressly incorporated by reference herein.

What is claimed is:

1. A liquid emission apparatus having a head provided with a plurality of nozzles which each emits liquid, the head being provided with a plurality of pressure chambers, each of the plurality of pressure chambers being linked to each of the nozzles, the head being provided with a plurality of driver elements, each of the plurality of driver elements being provided correspondingly to each of the pressure chambers, the liquid emission apparatus being configured to emit the liquid from the nozzles by applying a driving signal to the driver elements, the liquid emission apparatus being configured:

to apply the driving signal to the driver elements so as to obtain a plurality of detected signals;

to decide whether one of the nozzles corresponding to one of the driver elements is causing a malfunction in liquid emission on the basis of one of detected signals;

to drive the one of the driver elements corresponding to the one of the nozzles again upon the malfunction in the liquid emission;

to omit to drive the other of the driver elements corresponding to the other of nozzles that have no malfunction in the liquid emission, and to drive the same driver element more than once so as to obtain the detected signals, the liquid emission apparatus being further configured to decide a state of the nozzle corresponding to the same driver element on the basis of a variation in the respective detected signals.

2. The liquid emission apparatus according to claim 1 further configured to compare a variation in cycles of the respective detected signals obtained by means of a fact that the same driver element is driven more than once with a first threshold, the liquid emission apparatus being further configured to decide whether the state of the nozzle is either a state in which no liquid is emitted or a state in which liquid is emitted although irregularly.

3. The liquid emission apparatus according to claim 1 further configured to drive the driver element in such a way that first vibrating force is provided so as to obtain a first detected signal, the liquid emission apparatus being further configured to drive the driver element in such a way that second vibrating force being stronger than the first vibrating force is provided so as to obtain a second detected signal, the liquid emission apparatus being further configured to decide a state of the nozzle corresponding to the driver element on the basis of the first detected signal and the second detected signal.

4. The liquid emission apparatus according to claim 3 further configured to compare a difference between an amplitude of the first detected signal and an amplitude of the second detected signal with a second threshold, the liquid emission apparatus being further configured to decide whether the state of the nozzle is either a state in which no liquid is emitted or a state in which liquid is emitted although irregularly.

5. A method for liquid emission to be used by an apparatus having a head provided with a plurality of nozzles which each emits liquid, the head being provided with a plurality of pressure chambers, each of the plurality of pressure chambers being linked to each of the nozzles, the head being provided with a plurality of driver elements, each of the plurality of driver elements being provided correspondingly to each of the pressure chambers, the apparatus being configured to emit the liquid from the nozzles by applying a driving signal to the driver elements, the method comprising:

applying the driving signal to the driver elements so as to obtain a plurality of detected signals;

deciding whether one of the nozzles corresponding to one of the driver elements is causing a malfunction in liquid emission on the basis of one of detected signals;

driving the one of the driver elements corresponding to the one of the nozzles again upon the malfunction in the liquid emission;

omitting to drive the other of the driver elements corresponding to the other of the nozzles that have no malfunction in the liquid emission, and driving the same driver element more than once so as to obtain the detected signals, and deciding a state of the nozzle corresponding to the same driver element on the basis of a variation in the respective detected signals.

* * * * *